US005537479A

United States Patent [19]

Kreisel et al.

[11] Patent Number: 5,537,479

[45] Date of Patent: Jul. 16, 1996

[54] DUAL-DRIVER BASS SPEAKER WITH ACOUSTIC REDUCTION OF OUT-OF-PHASE AND ELECTRONIC REDUCTION OF IN-PHASE DISTORTION HARMONICS

[75] Inventors: Kenneth W. Kreisel, La Canada Flintridge; Lester M. Field, Los Angeles, both of Calif.

[73] Assignee: Miller and Kreisel Sound Corp., Culver City, Calif.

[21] Appl. No.: 235,552

[22] Filed: Apr. 29, 1994

[51] Int. Cl.[6] ..... H04R 3/00; H04R 1/02

[52] U.S. Cl. ..... 381/96; 381/89; 381/97

[58] Field of Search ..... 381/89, 96, 83, 381/59, 97, 98, 116, 117, 24, 111, 59, 150, 163

[56] References Cited

U.S. PATENT DOCUMENTS

| | | | |
|---|---|---|---|
| 4,016,953 | 4/1977 | Butler | 381/89 |
| 4,182,931 | 1/1980 | Kenner | 381/89 |
| 4,387,270 | 6/1983 | Sakano et al. | 381/117 |
| 4,528,691 | 7/1985 | Edwards | 381/89 |
| 4,573,189 | 2/1986 | Hall | 281/96 |
| 4,704,729 | 11/1987 | Franzini et al. | 381/89 |
| 4,727,584 | 2/1988 | Hall | 381/96 |
| 5,073,945 | 12/1991 | Kageyama et al. | 381/89 |
| 5,327,504 | 7/1994 | Hobelsberger | 381/89 |

FOREIGN PATENT DOCUMENTS

| | | | |
|---|---|---|---|
| 2338616 | 8/1977 | France | 381/89 |
| 0647371 | 1/1985 | Switzerland | 381/89 |
| 0659066 | 10/1951 | United Kingdom | 381/96 |

OTHER PUBLICATIONS

Velodyne (15" Subwoofer)—Advertisement.

*Primary Examiner*—Forester W. Isen
*Assistant Examiner*—Xu Mei
*Attorney, Agent, or Firm*—Ladas & Parry

[57] ABSTRACT

A modification and addition to the prior art type of multiple driver push-pull loudspeaker system for subwoofer, bass, or lower midrange frequencies, which prior system is able to reduce the even-order push-pull out-of-phase driver-produced 2nd, 4th, etc. distortion harmonics by the order of 15 to 25 dB in the radiated sound waves. The present invention reduces the important remaining in-phase distortion harmonics using outputs of sensors mounted on the voice coils of each driver to generate electrical signals which are processed and used to substantially lower the remaining in-phase distortion with feedback through a single signal amplifier chain. The present invention contributes from 15 to 30 dB of in-phase distortion reduction of odd-order harmonics and, at relatively high sound power levels only, also reduces some in-phase, relatively lower level, even-order distortion. In addition, separate electrical outputs processed from sensor motion can provide pure even-order harmonics in real time, which outputs can be made available for other possible uses. Obviously, the relatively pure odd-order harmonics normally fed to a mixer in the signal amplifier chain could also be used as a separate output if desired.

38 Claims, 17 Drawing Sheets

DUAL-DRIVER BASS SPEAKER WITH ACOUSTIC REDUCTION OF OUT-OF-PHASE AND ELECTRONIC REDUCTION OF IN-PHASE DISTORTION HARMONICS

BACKGROUND OF THE INVENTION

1. Field of the Invention

This invention relates to the field of sound reproduction, and particularly to apparatus for appreciably reducing distortion produced by non-linear aspects of the driver mechanisms of loudspeakers. More specifically, it relates to significant different and additional distortion reduction made possible by substantial modification of the high-fidelity subwoofer, bass, or lower midrange portion of a loudspeaker of the type which uses at least two almost identical drivers in a push-pull configuration to lower its out-of-phase, even-ordered (2nd, 4th, etc) distortion harmonics very substantially, as will be shown.

Present day feedback systems on loudspeakers (of which several embodiments exist) do not make use of, or distinguish between, in-phase and out-of-phase distortion harmonics. Actually, unless there are (at least) two almost identical drivers, mounted so that each is producing some distortion harmonics out-of-phase with the other, as is precisely the case for the type of push-pull described herein, the question of in-phase or out-of-phase does not even arise.

This push-pull configuration is a prior art concept in which the major even-order distortion harmonics (which contain the 2nd harmonic, usually the largest of all distortion harmonics) are greatly reduced because they are intentionally caused to be precisely out-of-phase as radiated, as between a normally mounted driver (or drivers) and an axially inverted mounted driver (or drivers), as will be explained in detail. What is presented here are some additions and modifications which constitute a specialized, different, and supplemental system capable of providing for the substantial reduction of specifically only the remaining distortion harmonics, a totally different class, all of which are known to be in-phase (as between the two drivers) harmonics and which can not be reduced by the original push-pull concept. From its conception, a new total system was sought which would retain the full operation of push-pull and allow no redundancy or modification of the push-pull system's excellent performance in distortion reduction to occur. This provides a number of important advantages which will be discussed in detail later in this document.

In effect, the invention consists of modifying a push-pull system by using two sensors responsive to motion (commercially available sensors can be suitable as electrical signal sources), one on each cone voice coil assembly of each of the two drivers. Further along the signal paths, a separation of in-phase from out-of-phase (distortion harmonics only), can be made continuously in real time, simultaneously for the many different sounds (and instruments) over the entire bandwidth the device needs, typically 3 or 4 octaves. After removing all the out-of-phase electrical distortion components from the electrical signals, since, remarkably, only the sound components cancelled acoustically out in the air, but the motions of the voice coils, sensors and the electrical signals they produced did not cancel, as will be discussed.

What is left is all the sound fundamentals, all their true undistorted sound harmonics, and all the in-phase distortion harmonics. These can now be fed to an electronic distortion reduction system, using negative feedback, since these are the exact set of signals necessary to reduce all in-phase distortion, maintain all undistorted sound with a moderate drop in gain (easily recoverable by boosting preamplifier gain in advance), and specifically preventing the in-phase system from handling the large, out-of-phase distortion harmonics that push-pull takes care of. Then neither system is spoiled by the presence of the other, and the total result is better than either of them working alone (to be discussed in detail later).

Previous negative feedback systems dealing with distortion harmonics, to the best of the inventors' knowledge, could only lower all distortion harmonics through negative feedback, without selection and therefore without benefit of gain margin relief from another form of distortion reduction as described herein, and obtain the resultant improvement in feedback stability, overload recovery, and high peak transient recovery problems, as well as certain other improvements described later in this document.

One additional advantage of the system to be described here is that it allows separate control of the reduction of two major groups of distortion harmonics, out-of-phase corresponding to purely even-order harmonics over all of the amplitude range and in-phase corresponding to purely odd-order distortion harmonics over almost all of the amplitude range as will be described later in detail. The possible value of separate and independent mechanisms to separate and control the two major groups will also be discussed.

2. Definitions of Terms Used in Prior and Current Art

Some definitions and conventions, as will be used in this description, are defined below.

Push-pull:

refers only and specifically, in this document, to an effective but seldom used prior art method of even-order distortion reduction by mounting in a cabinet one driver (or a group of drivers) in a normal position, that is magnet end in the cabinet, cone facing out, and another driver (or group of drivers) spatially inverted, magnet end out of cabinet, cone facing into the cabinet. (See FIGS. 1*a*, *b*, and *c*.) The two drivers (or groups of drivers) must be driven electrically out-of-phase from each other by a single (or in-phase multiple) power amplifier(s) which cause(s) the drivers to move and radiate all fundamental and true undistorted harmonic sound in-phase and all odd distortion harmonic sound in-phase. The only exception is of one type of very important distortion harmonics, the even-order (including the largest, the 2nd harmonic), produced out-of-phase by one of the few major types of driver non-linearity. For all undistorted sound and all in-phase distortion harmonics, both speakers' voice coils and their cones will move out from the cabinet space at the same time, and into the cabinet space at the same time (in-phase for sound as radiated). Please recall from this paragraph that all of the important acoustic sound waves emitted by both drivers are in-phase despite electrically driving the normal and inverted drivers out-of-phase. Therefore, the drive phase alone is clearly not sufficient cause to produce out-of-phase even-order distortion harmonics. The complete cause will be discussed shortly.

Speaker:

in this document, is generally meant a push-pull subwoofer, bass, or possibly lower midrange portion of a complete audio frequency total spectrum loudspeaker system, unless stated otherwise, and it will be understood to cover a limited frequency range, typically approximately 20 to 125 Hz for a subwoofer, 50 to 200 Hz for a bass, or 150 to 600 Hz for a lower midrange push-pull system.

Subwoofer or bass systems may generally be used occupying a separate, largest volume portion of a full range total spectrum (20 to 20,000 Hz) speaker cabinet including a midrange driver in a separate chamber and an acoustically closed-off, back of the tweeter. Or, most likely (but not necessarily) for a subwoofer, a separate cabinet of its own. FIGS. 1*a, b,* and *c* show useful patterns for driver positioning among other useful possibilities with the same principle (not shown). FIG. 1*a* is seldom used for subwoofers because large diameter drivers are used and the front area becomes too large for acceptable appearance. FIG. 1*a*, however, could be a good choice for bass or lower midrange. The largest margins for separation of the two drivers are in subwoofers because of the longest wavelength there, so FIGS. 1*b* and 1*c* are used, with 1*c* often preferable because a 1*b* cabinet, which needs to cleverly disguise the out-of-cabinet driver, may be costly.

Basically, a push-pull speaker consists of a cabinet or portion of a wide range total speaker cabinet, sealed except for circular openings, in which drivers (two or more) are mounted, one normally, the other inverted end-for-end and the drivers are electrically driven out-of-phase. The type system described in this document can also be adapted to vented cabinet systems.

Subwoofer:

is a device for producing audio output down to the order of 20 Hz or lower if required, and up to typically 125 Hz where a normal loudspeaker system can take over or where even quite small satellite speakers are often perfectly appropriate all the way up to 15 or 20 KHz. A subwoofer is often built with an internal amplifier and power supply (called self powered). Among other things, this is because human hearing at very low frequencies such as 30 or 20 Hz requires very high radiated sound power in order to be heard at all, and even more to sound loud. Precise relative levels will be given later. For the moment, consider that an 80 dB sound power level at 1000 Hz (loud) needs 109 dB SPL at 27 Hz to sound just as loud (~800 times the sound power level at the ear).

Driver:

is an assembly of a permanent magnet, magnetic flux carrying members forming a relatively uniform field in the gap of a voice coil and a sound radiating cone, with various flexible and rigid support members (see FIG. 2).

Harmonics:

as is commonly used, means a simultaneous production by a voice, instrument, or other sound source of many simultaneous, modified but almost sinusoidal waveforms which therefore necessarily includes harmonics of the fundamental. They come at integral multiples of the frequency of each fundamental sinusoidal waveform (in both electrical and sound form). The first harmonic is the fundamental waveform itself; the second harmonic is a sinusoidal waveform having a frequency of twice the fundamental frequency; the third harmonic, three times the fundamental, etc., and all of these originating in the sound, voice, or instrument being reproduced. The system described in this document handles all of these true sound harmonics as though they were all fundamentals and they are all radiated from the two drivers in-phase.

Distortion harmonics:

Distortion harmonics are at the same frequencies as true, original sound harmonics and occur at an integral multiple of the frequency of any fundamental sound or of any true sound harmonic or distortion harmonic strong enough to cause further (higher frequency) distortion, except that they originate (for the purposes of this document) due only to the deficiencies (non-linearities) of the loudspeaker drivers or other non-linearities of the speaker (or amplifier) system.

In-phase and Out-of-phase distortion harmonics:

defines the phase relationship between a distortion harmonic produced by a normally mounted driver (or group of drivers) and the same frequency distortion harmonic produced by the inverted other driver (or group of drivers) at the same time. Fortunately, the relationship appears to remain fixed as either in or out-of-phase over at least the first 8 (or more) harmonics, and usually after that number amplitudes are too small to be of much consequence.

Odd-order and Even-order distortion harmonics:

Odd-order (3rd, 5th, etc.) distortion harmonics are normally lower in amplitude than the previous (lower numbered) even-ordered distortion harmonics. See FIG. 10 for typical unreduced levels. Odd-orders turn out to be in-phase as between the normally mounted driver and the inverted mounted driver (or group of drivers) and begin to exist and rise in level as the fundamental level rises. Even-order distortion harmonics (2nd, 4th, etc.) begin to exist at even lower fundamental levels and grow as the level rises over the range of weak to very loud listening levels. They are out-of-phase for reasons that will be described in detail later in this document, and are specifically put out-of-phase by having one driver mounted axially inverted and the other mounted normally, i.e. not inverted.

A different and lower amplitude group of even-order distortion harmonics can become of modest significance at higher levels of fundamentals and tend to be quite small themselves (typically 15 to 20 dB down compared to the evens previously mentioned), except in the highest 4 or 5 dB of fundamental level which the drivers are capable of generating. They are in-phase as between inverted and non-inverted drivers and are not caused by non-linearities in the drivers but rather are dependent, on the cabinet's internal volume and the non-linear compression of air in it. They are highly dependent on this volume so a modest increase in cabinet volume can delay their onset and reduce their level.

BRIEF DESCRIPTION OF THE PRIOR ART

Characteristics of a Push-Pull System

It will be useful to describe in some detail what push-pull loudspeaker systems do very well and what they fail to do, in order to understand how one can avoid disturbing what they do well and take care to do what is beyond a push-pull system's possible scope of distortion reduction. Also, it is important to understand them in order to be able to provide remaining distortion reduction with minimum additional cost and complexity while maximizing any additional benefits possible.

Referring again to FIGS. 1*a*–1*c* depicting alternate driver mounting schemes for push-pull operations, the arrows show the direction of the in-phase, outward, positive movement of both drivers' cones simultaneously. The sound fundamentals are in-phase radiating from both drivers, as are all true sound harmonics, that is, harmonics contained in the original sound. The distortion harmonics also radiate in-phase, except for one type, the even-ordered out-of-phase (which includes the largest single distortion harmonic, the 2nd). It is important to observe that these distortion harmonics are out-of-phase, but not because the driving voltage from the power amplifier is applied to the two drivers out-of-phase. That is necessary because one is mounted inverted compared to the other and needs to be driven what might be called backwards in order for both cones to move into the cabinet or out of the cabinet at the same time. If not driven this inverted way, all the true sound harmonics and fundamentals would cancel. The even-order out-of-phase distortion is generated out-of-phase (in time) under the mounting and driving conditions necessary for all the other fundamentals and harmonics to be in-phase as radiated. Why the even-order out-of-phase does this will be discussed in detail in the next section.

It has been found that a sound whose wavelength is long compared to the diameter of a driver cone, radiates outward essentially equally well from the back of a cone (with what is normally considered the front facing into the cabinet), as from the front of a cone facing outward, particularly at bass frequencies. At bass frequencies, the cone shape has no effect on the direction of the sound, which comes out into the room equally in all directions (omnidirectional), but it is primarily used to provide a very light, stiff, easily moveable membrane. The degree of equality of radiation from a back and a front of a cone can be seen from evidence that a positive phased distortion half-wave on one driver is effectively cancelled by a negative phased distortion half-wave on the other (inverted) driver, lowering the 2nd and 4th order out-of-phase distortion harmonics by the order of 24 and 14 dB (or about 1/250 and 1/25 of the power in each of the original sound waves) as shown in FIG. 10. The 1/25 reduction of the 4th is to a harmonic that is already 15 dB below the 2nd harmonic before any harmonic reduction mechanism is applied.

Only distortion harmonics can be out-of-phase in a device such as this, and only if at least some distortion contributions to the cone movements of the two drivers are asymmetrical, e.g. one driver produces, among many other simultaneous distortion waves, a succession of small-large-small amplitude waveform halves while the other produces a succession of large-small-large waveform halves (which would cause there to be 2nd, 4th, etc. even-order out-of-phase distortion harmonics of their fundamentals). It should be noted that these distortion harmonics are out-of-phase (as between the two drivers) for reasons set forth in the next paragraph and will almost completely cancel as they travel out from the speaker system. The fundamentals and their true sound produced harmonics, both odd-order and even-order, are all radiated in-phase in a properly driven push-pull device and they do not cancel acoustically.

Cancellation of Even-Order Out-of-Phase Distortion Harmonics by Push-Pull

Push-pull out-of-phase distortion harmonic cancellation is achievable, in part, because precisely when one voice coil cone assembly is moving away from its "magnet", away from the whole driver magnet assembly (shown in FIG. 2), the other is moving towards its "magnet", even though both voice coils (and both cones) are moving away from the inside of the "cabinet" and on the next half cycle both cones are moving toward the cabinet. Since, as shown in FIGS. 3*a* and 3*b*, the magnetic field just outside of the gap falls off much faster at the open end of the gap than at the magnet or closed end, then for the large cone excursions experienced at bass frequencies, when the voice coil moves partially out of the pole piece gap and away from the permanent magnet, it's motion will be different than it will be when moving out of the gap toward the magnet. It follows that the motion produced when a sine wave current flows through the voice coil makes a larger half wave in one direction than in the other.

From Fourier series concepts, it is known that such an unbalanced amplitude upper half to lower half deformed sine wave must have even-order harmonics, 2nd, 4th, etc. Also, since the peak of the motion away from the magnet on one driver is occurring exactly when the peak of the motion toward the magnet is happening on the other, the 2nd, 4th, etc. distortion harmonics on one driver are exactly out-of-phase with the 2nd, 4th, etc. distortion harmonics on the other driver. It turns out that the motion of the two cones attached to the voice coils will produce sound waves whose 2nd (and 4th) harmonics are able to cancel each other by typically the order of 24 dB (and 14 dB) out in the room (acoustically) in a typical case as referred to previously in FIG. 10.

The distortion harmonics just described are called out-of-phase (as between the two drivers). The distortion harmonics which turn out to be greatly reduced by such acoustic cancellation are the out-of-phase even-order, 2nd, 4th, etc., harmonics (see FIGS. 4*a*–4*c*). All of this is prior art, but it works well at all levels of fundamentals including the highest, and shows excellent behavior through transients and large overloads with essentially instant recovery. The system has been so well received in the marketplace, that it became clear that acoustic cancellation might well be included in future systems and carefully protected from disturbance from whatever was found to be necessary to lower remaining distortion.

Doubled Efficiency and Power Handling Ability of All Dual-Driver Systems Radiating Acoustically In-Phase It is also to be noted, which will not be mentioned again herein, that it is well known in the audio art and is considered very useful, that two essentially identical drivers which are close to each other compared to a wavelength and which are in-phase acoustically not only are able to double the power handling ability or power dissipation (which is important since only a small percentage of the amplifier power fed in to a driver goes into acoustic power radiated), but also each driver doubles its efficiency of transforming electrical to sound power. That means that by using twice the amplifier power, the maximum radiated sound power, with the same cone excursion limits, goes up by four times.

This phenomenon works well for subwoofers and up into the lower mid-band frequencies, but not too well above that, because the wavelengths get too short compared to speaker diameter and separation, so the waves begin to partially or completely cancel in some directions rather than add.

One explanation for the doubling of efficiency is that the power transferred from the electrical power to the sound wave power doubles because each cone moves its excursion distance against not only its own produced increased sound pressure in the air outside and a half cycle later against the air inside, but also against the sound pressure produced by the other driver. It can be observed that such a system shows a 6 dB power gain (or 4 times the SPL), on any accurate SPL meter, if operated at any frequency for which the wavelength is substantially longer, e.g. 4 times or more, than the difference in distance to the two drivers from the observation point. It is also necessary that they be driven to each receive an amount of electrical power equal to what is put into a single unit for comparison. In effect, the power into the radiating elements is doubled and the conversion efficiency of electrical into sound power is doubled, hence a 6 dB power increase which is 4 times the sound power level.

In-Phase, Out-of-Phase, Odd-Order, Even-Order Considerations

In a physical mechanism such as a loudspeaker driver, the distortion harmonics radiated from the drivers, each relative to the other driver, could conceivably be in-phase (timewise), or out-of-phase. Which one can depend on whether the cause of the distortion reverses phase in the axial direction (such as it does for a distortion caused by the difference in the shape and strength of the permanent magnetic fields along and just forward and back of the voice coil gap, when one driver is mounted magnet-end facing out and the other is mounted cone-end facing out), or whether the cause of distortion does not invert (such as a nonlinear compression of air in the cabinet which stays in-phase for both drivers when they both move inward and a half cycle later outward with respect to the cabinet, necessarily together, no matter whether the cones both face out, as in a non push-pull system, or one faces in and one faces out, as in a push-pull system, as long as the drivers of each pair are correctly driven in-phase or out-of-phase electrically as previously described). FIGS. 4*a, b, c,* and *d* show the out-of-phase distortion harmonics produced when the peaks are asymmetrically smaller in one driver and larger in the other and in the next half cycle reverse positions as between the two drivers. FIGS. 4*e* and 4*f* show the in-phase 2nd and 4th order distortion harmonics produced in normal and inverted drivers from compression of air in the cabinet.

The odd-order (3rd, 5th, etc.) distortion harmonics are primarily in-phase as determined both by measurements and the logic of their cause, which is described next. As a result, they are essentially not affected by the push-pull inversion process, which indicates a need which the invention to be described can satisfy. The motion of a voice coil carrying a sine wave of current interacting with a permanent magnetic field (which drops off quite sharply and almost symmetrically at both ends of the interaction gap) and with rapidly changing force (see next paragraph) will, at moderate to high sound power levels (which implies rather large excursions from the undisplaced position), lead to a symmetrical effect of flattening (if from the limit of stretched surround or spider) as in FIG. 4*g*, or at a lower level of cone excursion, peaking above normal sine wave shape (if from a drop-off in the magnetic field) at the upper and lower extremes of an otherwise sinusoidal voice coil motion as in FIG. 4*h*.

According to the verifiable concepts of H. D. Harwood of the B.B.C. (as referred to later), when the voice coil moves into a lesser magnetic field, the movement of the voice coil is increased, not lowered. One might too quickly assume such a lesser magnetic field produces less force proportional to B, the magnetic field strength, hence less movement against the normal restraints, spider and surround stretching, plus internal air pressure change. However, due to a strong $1/B^2$ effect on the current flow through the voice coil because of what is called the motional impedance drop, the opposite effect is realized. The $1/B^2$ effect allows the current in the voice coil to increase as the square of the magnetic field drop, and the final result is more force, not less (until the increase in current stops because the impedance drop cannot fall below the normal resistance of the wire in the voice coil). This will be further discussed later with reference to an Audio Engineering Society published paper.

Although it would make no difference to the principles of push-pull or to the effects of the modifications and additions of the invention being described, it was thought to be preferable to factually state the physics involved, i.e., in this analysis of the voice coil movement in the gap, a decrease in B field (as described in the A.E.S. article) produces an increase in force. Of course, beyond a certain level of decrease, the non-linearity flattens out, but that level is not reached in most cases.

With respect to enlarged force resulting from the voice coil moving in a weaker magnetic field B (because the current flow rises faster, as $1/B^2$, than the magnetic field B declines), this process reaches a limit when the average flux drops so much that the motional impedance drops low enough that it is no longer the determining factor in controlling current. The resistance of the coil is high, typically 8 ohms or 4 ohms, and does not drop, and the non-linear expansion collapses. Interested parties may follow this phenomenon from an article by H. D. Harwood of the BBC research organization in the Journal of the Audio Engineering Society, Volume 20, No. 9, Nov. 1972, pp. 718–728. Suffice it to say the drawings of motion and position associated with large and small half waves shown in FIGS. 4*a*–4*c*, and the peaked rather than flattened sine waves of FIG. 4*h* are in agreement with this not so widely known effect from the decrease in flux beyond the edges.

In-phase even-order distortion harmonics do occur in the prior art push-pull system but may have been or may not have been observed. They were controlled by the early models of the complete present invention, and when the electrical part of the invention was switched off, they suddenly visibly modified the even harmonic levels at exactly the correct 2nd, 4th, etc. harmonic frequencies on a spectrum analyzer.

The curtailing or flattening of the motion of both drivers when moving into (but not when moving out of) the cabinet at high levels due to non-linear compression of the air in the cabinet is, of course, a true flattening (involving no consideration of B compared to $B^2$) as shown in FIGS. 4*e* and 4*f*. This is a return of even-order (2nd, 4th, etc.) harmonics despite push-pull cancellation (which they spoil slightly), but this time they come back in-phase in both drivers, in contrast to out-of-phase. However, they are generally quite small and handled by the in-phase only negative feedback system to be described here, to reduce their amplitude compared to the desired in-phase real undistorted audio sound signals. These in-phase but even-order distortion harmonics, while coming from high level fundamentals, tend to be fairly low level in amplitude and thus do not tend to significantly offset (raise) the enormous drop in 2nd and 4th from push-pull cancellation except as the fundamental level rises up to the top few dB of which the drivers are capable. The proposed invention described here, without intending to do so, provides a system which operates to drop these even-order harmonics to about 4 dB below the typical order of 15 to 25 dB reduction that push-pull produces as shown in the experimental results of FIG. 10.

SUMMARY OF THE INVENTION

After a number of false starts, an idea arose on how an in-phase only negative feedback system might be constructed that could avoid any interference with the push-pull system. It arose from observation and knowledge that the push-pull system cancelled out-of-phase even harmonics in air at both moderate and substantial distances from the drivers and that typically radiation of sound from all cone type drivers carries away (by sound power) only 1% or 2% percent of the electrical power necessary to accelerate and decelerate the voice coil-cone assembly mass rapidly enough and linearly enough considering all its restraints. Practically all the power ends up heating the voice coil, all the driver elements, the air in the cabinet and the cabinet walls. Even with the already mentioned doubling of the efficiency for paralleled drivers, 2% to 4% efficiency left the motions essentially unchanged, because using 96% of the energy just to move the cones against the restraints allows the motion to be almost exactly the same, although the sound in the air had almost cancelled (24 dB and 14 dB deeply reduced even-order distortion harmonics).

Therefore, the motions still contained the full array of signals necessary to generate all the negative electrical feedback signals needed and also important, contained almost exact out-of-phase motions which if converted to electrical signals could be carefully balanced in magnitude and caused to cancel each other so that when the array of remaining signals were used in a negative feedback system, no change in the push-pull acoustic cancellations or change in the motions associated with out-of-phase even-order distortion harmonics would occur, This was tried and after some refinements and discoveries led to exactly the goal desired.

The present invention overcomes the deficiencies of the prior art by providing a method and apparatus for reducing in-phase distortion harmonic components and out-of-phase distortion harmonic components, produced by an audio unit and attributable to the audio unit's deficiencies.

According to the invention, providing an audio input signal is inputted to the audio unit for producing an audio output from the unit, the audio output including all said in-phase and out-of-phase distortion harmonic components. All fundamental and harmonic components of the audio output are sensed, including all in-phase distortion harmonic components and all out-of-phase distortion harmonic components attributable to the audio unit's deficiencies. The out-of-phase distortion harmonic components are directly cancelled by an additive function. The sensed out-of-phase distortion harmonic components are separated from the remainder of the sensed audio output, and the separated remainder of the sensed audio output is fed back to the audio unit to alter the effects of the audio input signal in a manner to substantially cancel only in-phase distortion harmonic components in the audio output which were not components of the audio input signal.

The best example for the application of the invention is in the field of loudspeakers.

The present invention overcomes the shortcomings of the prior art noted previously by providing a method and apparatus employing electrical signals which are produced by two inertial (or other) sensors mounted on at least two moving elements, one on the normally mounted driver and the other on the inverted mounted driver. The electrical signals still have all fundamentals including their real sound harmonics and all distortion harmonics, both in-phase and out-of-phase. The push-pull cancellation of even-order out-of-phase distortion sound harmonics happens as the waves travel out from each driver out-of-phase in air. These even-order out-of-phase distortion harmonics can still be seen by using a microphone in the near field close to the cone surface of each driver in turn, and in the electrical signals developed from each sensor's output just before the out-of-phase electrical signal components are balanced and cancelled against each other.

The signals that remain are exactly the proper electrical signals to enable a negative feedback loop to greatly reduce "only" in-phase distortion harmonics. Such in-phase distortion harmonics are not removed by prior art acoustic cancellation systems alone. The effects on, or absence of effects on, all these types of distortion harmonics will be described later in this specification. (It may be useful to note at this point that for a different kind of application, it would be possible to invert one of the two sensors' derived signals and cancel out all real sound signals and the in-phase distortion and leave only the out-of-phase (or even) distortion harmonics. So, in effect, this system can provide either the in-phase or out-of-phase distortion or both on separate paralleled channels).

As mentioned previously, it is, of course, not the object of the present invention to re-invent the widely known push-pull speaker idea, but rather to teach system additions and modifications which protect its performance from change. This allows push-pull to continue to do everything it did well (to substantially reduce 2nd and 4th, etc. even-order, out-of-phase distortion harmonics acoustically, with good behavior through large overload and high level transient conditions) without supplanting or modifying the push-pull function, while adding to it the lowest load possible (two very light sensors) on another mechanism that substantially reduces "only" in-phase distortion components; specifically 3rd, 5th, etc. odd-order in-phase distortion, as well as a later discovered lower amplitude level of 2nd, 4th, etc. even-order but also in-phase distortion from a different source mechanism than that even-order out-of-phase which push-pull greatly lowered. The different source is compression of air by the cones moving into the cabinet, in acoustic phase, and it is of negligible importance (less than 3.5 dB) at any fundamental levels lower than 10 dB below the highest and of moderate importance (13 dB or so for the 2nd) within a few dB of the highest fundamental sound levels the drivers are capable of generating. Such even-order in-phase distortion harmonics also cannot be reduced at all by a purely push-pull system. See FIG. 10 for operation as measured on a Hewlett-Packard 3561, set in its spectrum analyzer mode and operating with one pure fundamental at 10 dB below the highest level obtainable from the pair of 12" diameter drivers used. Highest level charted curves using a flat window (wide) are without push-pull and without electronic feedback. Next highest curve is with a push-pull arrangement, lowest curve is with push-pull and electronic negative feedback.

The word "only" in the previous two paragraphs is a key to a need for the system according to the present invention. It is essential for the intent of this invention that the feedback loop carry no appreciable out-of-phase harmonics for a variety of technically and commercially important reasons, which will be presented later in this description. To repeat an earlier statement, present day feedback systems on loudspeakers (of which several embodiments exist) do not make use of, or distinguish between, in-phase and out-of-phase distortion harmonics. Actually, unless there are (at least) two almost identical drivers, mounted so that each is producing some distortion harmonics out-of-phase with the other, as is precisely the case for the type of push-pull described here, the question of in-phase or out-of-phase does not even arise.

Out-of-phase distortion harmonics, as between the two drivers, occur, to the extent of the inventors' knowledge, only when one driver is mounted axially inverted relative to the other (or an equivalent electrical system is caused to mimic this type of non-linearity). It is also to be noted that the purely acoustical distortion harmonic reduction system of the other form of prior art (push-pull) uses no sensors to produce electrical signals. In comparison, the present invention does employ two inertial, or other type sensors, and handles (in a special way) the electrical signals which they generate (and which are quite different from each other in a predictable manner). In essence, the essentially equal (as between the two drivers) out-of-phase components of the 2nd, 4th, 6th, etc. distortion harmonic motions produced by asymmetrical magnetic forces on each driver's voice coil-cone system causes out-of-phase sound waves to radiate outward from the drivers and cancel acoustically in air. Signals can be generated from the motion and can be made to cancel their even-harmonic out-of-phase content in the electrical signal system while the remaining fundamentals and true sound harmonics as well as the in-phase distortion harmonics remain uncancelled in this electrical system.

These are exactly the proper signals to feed to a negative feedback loop using a single channel of mixer, gain stages with proper phase correction and EQ (gain vs. frequency fixed modification for stability, called equalization). They then feed a single power amplifier or its equivalent in multiple in-phase amplifiers driving the two drivers electrically out-of-phase (which implies acoustically in-phase) to properly reduce all types of in-phase distortion harmonics and all without any interference with, or reduction of, the basic acoustic cancellation of out-of-phase even-order distortion harmonics. Also, to the extent that all (both even-order and odd-order) of the distortion harmonics which may exist are simultaneously greatly reduced, the theoretical transfer function from input to output of a moderately wide audio channel (20 Hz to 125 Hz for low bass loudspeakers, or 125 Hz to 600 Hz for mid-bass loudspeakers) is greatly linearized, and therefore the level of a different type of distortion called intermodulation distortion is likewise substantially reduced, which will be touched on again later.

The power that goes into radiated sound distortion can be as large as 25% (or more) of (only) the total radiated signal power (50% distortion as usually quoted in terms of voltage) and the power in distortion harmonics needs to be reduced by a factor of approaching 1,000 or more (30 dB down for 2nd and 3rd) in order to become relatively unnoticeable by a listener. That corresponds to 3% in voltage terms. The exact amount of reduction necessary may be relieved in many cases by masking by other signals which may be close by in frequency and of substantially higher levels. Considering that the goal being described is for a loudspeaker at high excursion levels and low frequencies 3% is difficult but can be done.

As the experimental result charts of FIGS. 10 and 11 show, the two processes used in the devices described herein reduce distortion by amounts of the order quoted in the previous paragraph. One of the mechanisms does it by cancelling many pairs of out-of-phase distortion waves by cancelling the out-of-phase members in each pair against each other acoustically. The other mechanism does it by causing negative feedback to create negative input signals of all in-phase distortion harmonics that greatly limit any motion not called for by the undistorted input signals. For the proper operation by the push-pull mechanism in air to occur requires the removal of all out-of-phase pairs of distortion harmonic electrical signals prior to their entering the feedback loop. That this is what is taking place is easily determined by switching off the power to the sensors and their preamplifiers. The 24 dB drop of the 2nd harmonic as shown in FIG. 10 remains essentially unchanged, but the 24 dB drop in the 3rd harmonic disappears and the 3rd shows an amplitude 17 dB higher than the 2nd as seen simultaneously on a Hewlett-Packard 3561A Spectrum Analyzer. Switching the sensors and their preamps back on the 3rd drops its proper 24 dB. With the negative feedback off again moving the microphone close to a single driver (1 foot or 6"), the 2nd harmonic climbs up to only 10 dB or so below the fundamental. Then move out to a distance where the radiation from both drivers have an almost equal opportunity to get to the microphone, the 2nd harmonic drops back as it should. One precaution needs to be taken, most typical rooms have bad standing waves with deep nulls. Care should be taken not to have the microphone in such a null if the measurement is to make sense.

After electronically removing the out-of-phase signal content as between the two sensors, the effect of the remaining signals, containing all in-phase distortion harmonics and all fundamentals (including all the harmonics associated with the initial source sound) is the near complete removal (or great reduction) of the in-phase distortion harmonics, by negative feedback. In FIGS. 10 and 11, it is observable that the measured results of a working system shows that push-pull greatly lowers the out-of-phase 2nd and 4th distortion harmonics and in many cases the 6th (often below the lowest level shown on the graph, which may be 50 dB or more below the fundamental). All the odd harmonics (as well as the low and then only moderate level in-phase even harmonics at or near the highest sound pressure levels of radiation) are taken care of by negative feedback. The advantages of handling the two types of distortion by two separate mechanisms are discussed in some of the material which follows. Later, in the Detailed Description of the Preferred Embodiments, a general list of advantages provided by such a system is provided.

In addition to maintaining the effectiveness of the acoustical near cancellation of out-of-phase distortion harmonics, the ability of the present invention to cause only in-phase distortion harmonics to be reduced by the above mentioned electrical feedback system also allows it to be applied to both drivers through a single power amplifier. The amplifier is connected to both drivers with one driver attached to the amplifier in opposite phase from the other but facing its magnet side out of the speaker cabinet while the other is facing its cone side out. This inversion of polarity of connection, as well as reversal of which side of the cone pushes against the air outside of the cabinet on the inverted mounted driver, causes the basic input fundamental frequencies from the initial sound source and their even-order and odd-order natural sound harmonics radiated by both drivers to be in phase. Also, in-phase distortion signal harmonics generated by each of the two drivers as detected by inertial sensors on each of the drivers and then put through a summing (and out-of-phase signal cancelling) amplifier and sent as a single correction signal to the negative terminal of a feedback mixer stage whose positive terminal is fed by the audio input signal and whose output goes through one amplifier chain and one power amplifier (with the amount of signal determined by negative feedback comparison with the input audio signal) to greatly lower both drivers' production of in-phase distortion harmonics simultaneously.

If either of the out-of-phase distortion harmonic signals from the sensors were used in the feedback loop, they would have to be separately sent to each driver, because if either one was used alone to feed a single amplifier chain and power amplifier, it would greatly reduce distortion on one driver, but greatly increase it on the other. Recall that a single true sound signal makes both drivers respond in-phase for sound but the distortion sound is out-of-phase as radiated. So using either one of the signals from the two sensors would cause the sound from one driver to be cancelled but the other would be doubled. Other effects such as instability would be even worse, so this is not a good course to pursue. Of course, two amplifiers would have to be used, one for each driver, but that would be redundant in using a complete second feedback chain and power amplifier, and would take no advantage of the excellent large signal behavior of the acoustic cancellation of the even harmonics in a push-pull system. It is indeed fortunate that there is almost no reason for the in-phase distortion harmonics as well as the out-of-phase distortion harmonics to be other than almost identical in the two drivers, and separate measurements on each, show this to be the case.

After the isolated output signals from the two sensors are in-phase summed and out-of-phase cancelled, the resultant is combined with the input signal at the input mixer of a feedback system and works as follows in terms defined in the next paragraph. Provided that the gain of the amplifier system after the mixer input levels and to the output of the power amplifier is defined as $A_1^2$, everything from the combined sensors' output signal (which includes all input signals amplified and all in-phase distortion generated by the drivers but very little or no out-of-phase distortion) is then sent back after being properly reduced by attenuation (by an amount defined in the next paragraph) and fed into the negative terminal of the mixer input, where a part of it gets multiplied (amplified) by a factor $A_1$ from the value at its plus mixer terminal input value. This includes the desired audio input signal fundamentals and all their voice or instrumental natural harmonics. Anything sent back, e.g. distortion produced by the speaker (or amplifier) which finds nothing to match against coming in the plus terminal, gets divided by $A_1$.

As more fully described later, if $A_1^2$ is the voltage gain of the system without feedback, and the feedback attenuation $\beta$ is $(A_1-1)/A_1^2$ (which is $1/A_1$ for large values of $A_1$ compared to 1), then with feedback the gain is $(A_1-1)$ which is approximately $A_1$ (when $A_1$ is large compared to 1). The output will then be (Sound Fundamentals+Sound Harmonics) times $A_1$+Speaker (and Amplifier) Distortion Harmonics times $1/A_1$. A derivation of this is presented at the end of this specification with reference to FIGS. 12 and 13.

The ability to use a single amplifier is a simple, but economically important, factor in providing a substantially lower cost, single feedback loop and single power-amplifier system. Additionally, since, at normal sound levels, the lowest order harmonic which needs to be suppressed by feedback is the 3rd, it permits a lower level of feedback (which has cost, stability, and high level transient or sustained high level recovery advantages). The primary major distortion, second harmonic, is lowered (by typically 24 dB) and so are all other out-of-phase distortion harmonics lowered by large moving elements such as voice coils, cones and sound pressure waves in the acoustical out-of-phase distortion harmonic cancellation. Negative feedback is called upon to slightly further lower 2nd harmonic and other relatively low level in-phase even-order distortion harmonics. Of course, the negative feedback takes care of all the in-phase odd-order distortion harmonics.

Since out of all signals created by the inertial sensors (mounted on the moving cones of push-pull drivers) the out-of-phase electrical content is essentially eliminated prior to entering the feedback loop, the acoustical cancellation continues to work basically undisturbed. Substantial other reasons for desiring to use two separate mechanisms for the two separable types of distortion harmonics will be described later in this specification when a few more of the details of operation are discussed.

The system described here is by no means a straightforward application of conventional feedback to a normal in-phase dual-driver non-push-pull system, or even to a normal plus inverted driver true push-pull system which would require two feedback chains and two power amplifiers to use feedback at all. Rather, using one amplifier only, the system manages to use acoustic cancellation, throughout all levels of sound for out-of-phase even-order distortion harmonics, and feedback (selective to in-phase only) throughout all levels of in-phase odd-order distortion, and in-phase relatively low level even-order except at the highest sound power levels (SPL). Of course, one could use one driver only and a single channel of feedback and one power amplifier as is commonly done, or two drivers in parallel facing the same way out of a cabinet with one feedback channel and get doubled efficiency but none of the other advantages of push-pull with protective feedback which will be described and would cost almost exactly the same.

Until careful tests and measurements were being made on the present invention, the in-phase even-order harmonics had not been anticipated, since the customary thinking in this field of endeavor was mainly geared to even-order distortion harmonics being out-of-phase (the concept that led to the first use of push-pull) and odd-order harmonics being in-phase, but when some low or moderate level change in even-order harmonics appeared in the laboratory when the electrical in-phase distortion harmonic suppression system of the present invention was turned off, it was quickly understood what had happened.

If the inverted driver is removed and "reinstalled" facing in its so called normal direction (with phase connection to the power amplifier reversed to make it the same as the speaker's other driver, one can measure the original level of all harmonics with no push-pull and no feedback. The need for reinstallation is the reason many of the charted results on this project show no data for the case of no push-push, no feedback. However in some cases, such additional data were taken, as shown herein in FIG. 10, and separate data taken and just the tops marked on FIG. 11.

In the specific case of FIG. 10, it is worth noting that the level of 2nd and 4th order distortion harmonics needing correction by the feedback system is 24 dB and 14 dB lower, respectively, than it would have been without acoustic cancellation, and all that the feedback system needs to handle is the in-phase 2nd and 4th distortion harmonics at a much lower level (as just described) and in-phase even-order distortion harmonics are then correctable, respectively, in the 2nd and 4th distortion harmonics by 3.5 dB and 3.5 dB additional, for a total of 27.5 dB and 17.5 dB reduction. There is a larger drop of in-phase 2nd harmonic in FIG. 11 as compared with FIG. 10 due to the fact that there is much more (13.5 dB instead of 3.5 dB) in-phase total 2nd harmonic correctable at the higher sound power levels (110 dB for the fundamental in FIG. 11 compared with 100 dB in FIG. 10). FIG. 11 illustrates characteristics of a system operating at very near the maximum usable upper power limit. The 2nd harmonic without push-pull is within 4 dB of the fundamental which calculates to a 63% distortion (virtually unusable). This is typical performance for the drivers used and only at this level or a few dB above will the drivers be useful but quickly approach 100% distortion until push-pull and the specialized in-phase only negative feedback are used to get down to 10% and below. Dropping the peak level roughly 10 dB takes THD to 2% and lower from there on down.

Advantages from Using Two Different Distortion Reduction Systems

Unlike complete negative feedback, the two separately controllable mechanisms provide much less of a problem for the feedback to take care of. It can use substantially lower gain in the feedback loop (the order of 10 to 15 dB lower) which gives a dual system advantages in stability of the feedback system, and helps problems of recovery from sharp peak or sustained overload sound levels.

A second opportunity of possibly great future importance is the clear separation over all of the range of output levels of the high level even-order distortion harmonic control as well as odd-order distortion harmonic control over all but the top five or so dB and partial control over the entire range. Odd-order distortion harmonic control (tainted a relatively small amount at the highest SPL levels only by relatively low level even-order distortion harmonics) can be accomplished by raising or lowering the gain in the feedback loop. Large even harmonic control of the out-of-phase evens is possible by insertion of a variable, high power dissipation resistor of the order of 0.4 to 1.2 times the nominal driver impedance in series with either one of the two drivers to provide some controllable unbalance to the out-of-phase even-harmonic cancellation. Alternatively, one can avoid dissipating the expensive power out of a fine low distortion power amplifier into a resistor and unbalancing the drive power to the two drivers by simply varying the balance control on one of the sensor preamplifiers and allow whatever desired amount of even harmonic to remain uncancelled. Since this uncancelled even-harmonic in the feedback loop cancels some even harmonic out, but raises it on the opposite driver one can adjust to the desired level of even harmonics. Inasmuch as the even and odd distortion harmonics constitute two classes of distortion which appear to have substantially different effects on the threshold of detection of unnatural or unpleasant sound by the human hearing system, it may prove advantageous to be able to control them independently at bass frequencies, which (to the inventors' knowledge) does not appear to have been done before.

Also, and confirmed after searching the literature and talking with some knowledgeable people in the electronic musical instrument field, separation of even and odd distortion harmonics on a real time basis with constantly changing complex signals to control their relative content appears not to have been done previously. The present invention thus may define the first isolation of content of odd-order and even-order harmonics from program material and control of the relative amount instantly "in real time" at many frequencies simultaneously and over a wide frequency band such as 3 to 5 octaves. If the starting signals are pure tones with small or no harmonic content, the "distortion" harmonics become just harmonics whose level now comes under the control of the electronic instrument maker or user including whatever physical or electrical non-linear element is inserted in the signal path.

Further, this ability to control the relative level of odd-order distortion harmonics compared to even-order distortion harmonics is analogous to the current high respect for audio tube amplifiers which are noted for having almost only even-order distortion harmonics as contrasted with the long battle to minimize odd-order distortion in semiconductor amplifiers, now quite well solved, but which, for the first decade of transistor usage, was considered to be the cause of tinny sound or the "transistor" sound. Tube amplifiers are still a highly sought after item and, new or used, still cost almost unbelievable prices for quite low power levels.

In the music world, control of desired and undesired types of harmonics is a major factor in good instrument making, for example, great violins, as well as many other great musical instruments. The method earlier described of having both odd harmonic and even harmonic distortion on separately controllable channels may prove valuable for electrical instruments or recording either with speaker non-linearity or an electrically simulated non-linear element. To obtain a channel with even-order harmonics only, the outputs of the two sensors may, in parallel with the removal system already indicated, as shown in FIG. 5, be available if two signals are brought out from the sensor preamps 67, 69 just prior to the inverter 70, and fed into an additional summing and cancelling stage 90. This cancelling stage would cancel all in-phase signals and at its output present the summed out-of-phase signals which would be available to be amplified or lowered in level as purely even-order distortion harmonics to be added, if appropriate to a live instrument or recording process. Musicians control harmonics. Instrument makers control them. Perhaps this is an opening wedge to another type of harmonic control.

Again, the production of sizeable amounts of clean hearable deep bass is, to a great extent, the control of distortion. It must be kept in mind that the lower the frequency of a sound, up to about 150 Hz, the more difficult it is to hear. Above 5,000 Hz, when it becomes mildly (15 dB) more difficult, peaking at about 8 or 9 KHz, with another low and high above that. Above 50 dB SPL in sound level, the ear's sensitivity is almost level from 150 Hz up, except for a 7 to 12 dB increase in sensitivity around 4,000 Hz (traditionally the baby cry distress channel). The real battle to preserve quality of sound is in the low bass, 20 to 40 Hz and 40 to 80 Hz, regions of greatly lowered human hearing sensitivity, and at the same time, large speaker distortion.

To reiterate, the invention thus involves a new and significantly different method of reducing distortion harmonics (speaker-driver produced distortion coming at both the even and odd harmonics of each fundamental frequency) and doing this while preserving many fundamental and natural sound harmonic frequencies simultaneously without affecting the natural sounds. The method also helps lower intermodulation (or two-tone distortion) which consists of sums and differences of any frequency fundamentals being radiated by the driver cones. This produces much of the busy feeling between the sounds that obscures the desired replication of reality.

BRIEF DESCRIPTION OF THE DRAWING

The invention will now be described in detail having reference to the accompanying drawing, in which.

DETAILED DESCRIPTION OF THE PREFERRED EMBODIMENTS

It is the object of this invention to provide an entirely supplemental and different additional system to known push-pull systems, which, with the aid of a pair of signals generated by two inertial sensors 51, 52 (FIG. 8) placed on the drivers 3, 5 of the aforementioned original push-pull loudspeaker system (FIG. 1), helps to produce some very good and, in one class of distortion harmonics, initially surprising total results without detriment to, or replacement of, the useful results from push-pull cancellation of out-of-phase even-order distortion harmonics.

Figure 1A:
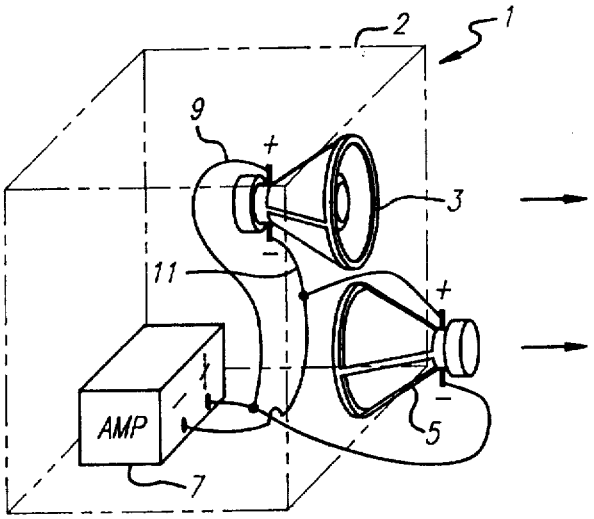
FIG. 1a PRIOR ART
FIGS. 1*a*–1*c* depict prior art push-pull speaker enclosure arrangements, indicating three different types of physical mounting of the drivers.
Figure 1B:
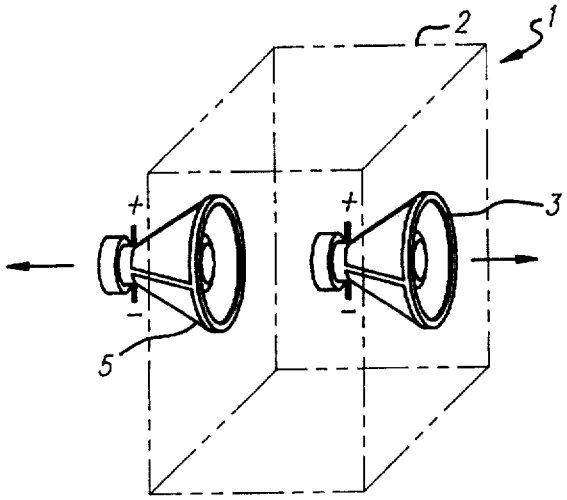
FIG. 1b PRIOR ART
Figure 1C:
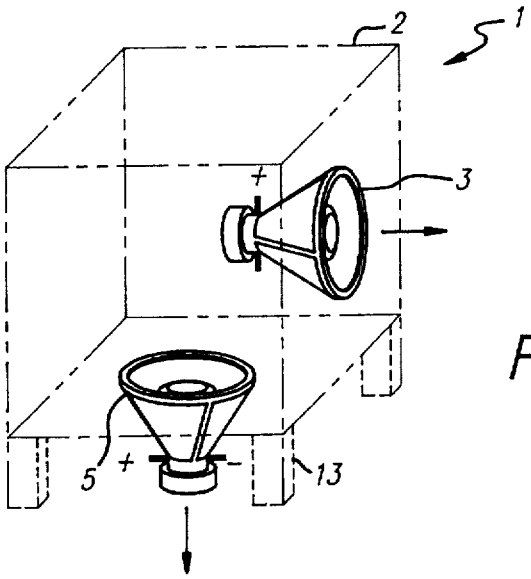
FIG. 1c PRIOR ART

Referencing FIGS. 1*a*–1*c*, the inventive concept is primarily applicable to a prior art push-pull type audio frequency subwoofer, bass, or lower midrange speaker system 1 in which two (or more) essentially identical bass (or midrange) drivers 3, 5 are used. The system to be described is one which is a new and very useful modification and extension of an old and previously known prior art push-pull system which is known to lower and almost cancel to an important degree (the order of 24 dB down), over a large range of amplitudes, the 2nd, and proportionally lower 4th, 6th and 8th, as well as higher orders of these even-ordered, out-of-phase distortion harmonics at low, medium, and to and including the highest, sound power levels producible by the drivers. In the prior art push-pull system, one loudspeaker driver 3 faces its cone outwardly from the speaker cabinet (as is conventional). The other driver 5 faces its cone inwardly, (its sound radiation, out to the room, comes from the back of its cone and out past the magnet structure). Such a system reduces (by cancellation of out-of-phase sound waves in the air space around the speaker) only what is called out-of-phase, (as between the two drivers), even-order distortion harmonics, which are essentially all of the even-order (2nd, 4th, etc.) distortion harmonics from a push-pull system, until the highest 10 dB or so of sound power level is reached and even there and above there is a relatively minor addition which the system proposed greatly reduces. FIGS. 4*a*–4*d* illustrate what is meant by out-of-phase for even-order distortion harmonics and simply illustrates some odd-order in-phase harmonics for comparison of the waveforms generated by the moving cones as between the two drivers. See FIGS. 4*g*–4*h* for in-phase odds. It is important to remember that in-phase and out-of-phase relationships, as discussed herein, unless otherwise noted, refer to what is going on with one driver as compared to the other.

Figure 4C:
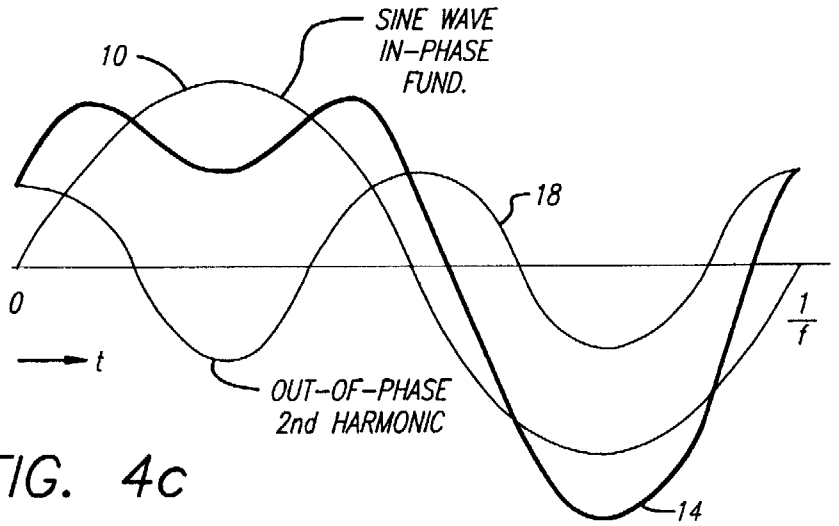
FIG. 4*c* shows a fundamental and 2nd distortion harmonic component for the inversely mounted driver of FIG. 4*a;*
Figure 4B:
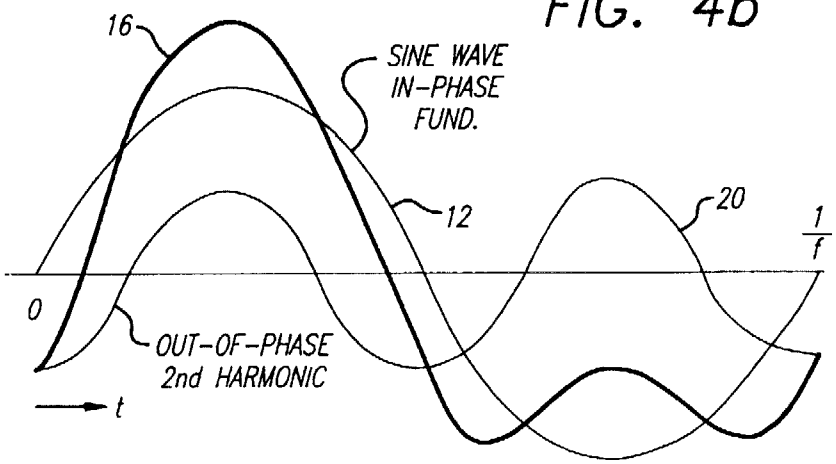
FIG. 4*b* shows a fundamental and 2nd distortion harmonic component for the normally mounted driver of FIG. 4*a;*
Figure 4A:
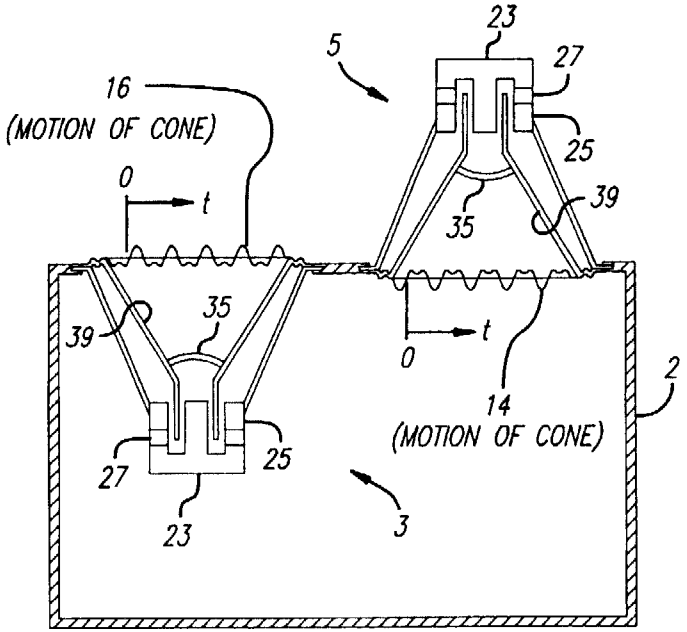
FIG. 4a PRIOR ART
FIG. 4*a* shows a cross section through a prior art loudspeaker enclosure mounting a pair of push-pull drivers.
Figure 4D:
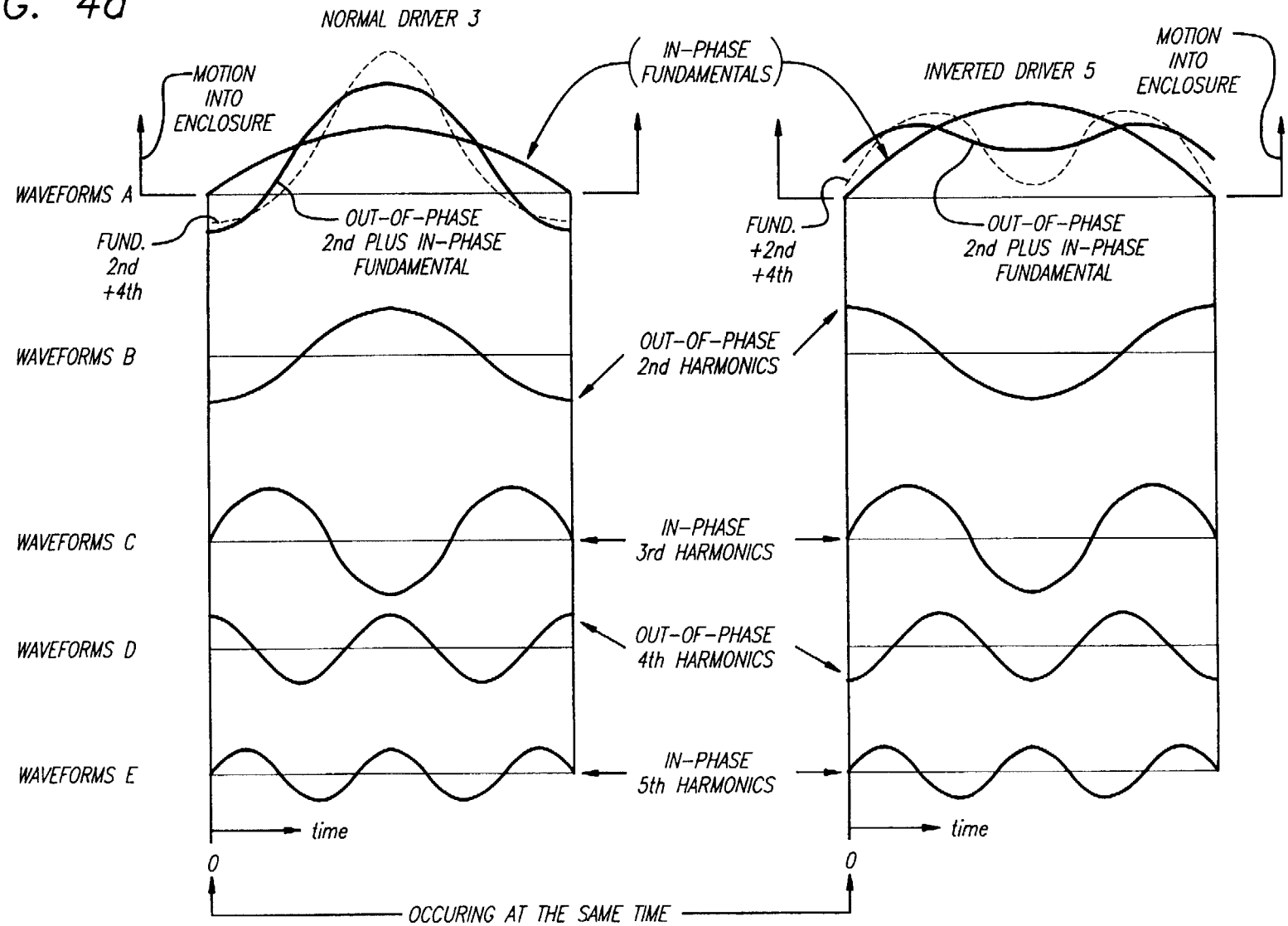
FIG. 4*d* shows the relationship between the motional waveforms of the normal and inverted drivers of FIG. 4*a* for low-to-moderate levels of sound resulting in out-of-phase even-order distortion harmonics, and in-phase odd-order distortion harmonics, as between the two drivers, are shown, just for comparison with the out-of-phase but are not added into the top waveforms.
Figure 4E:
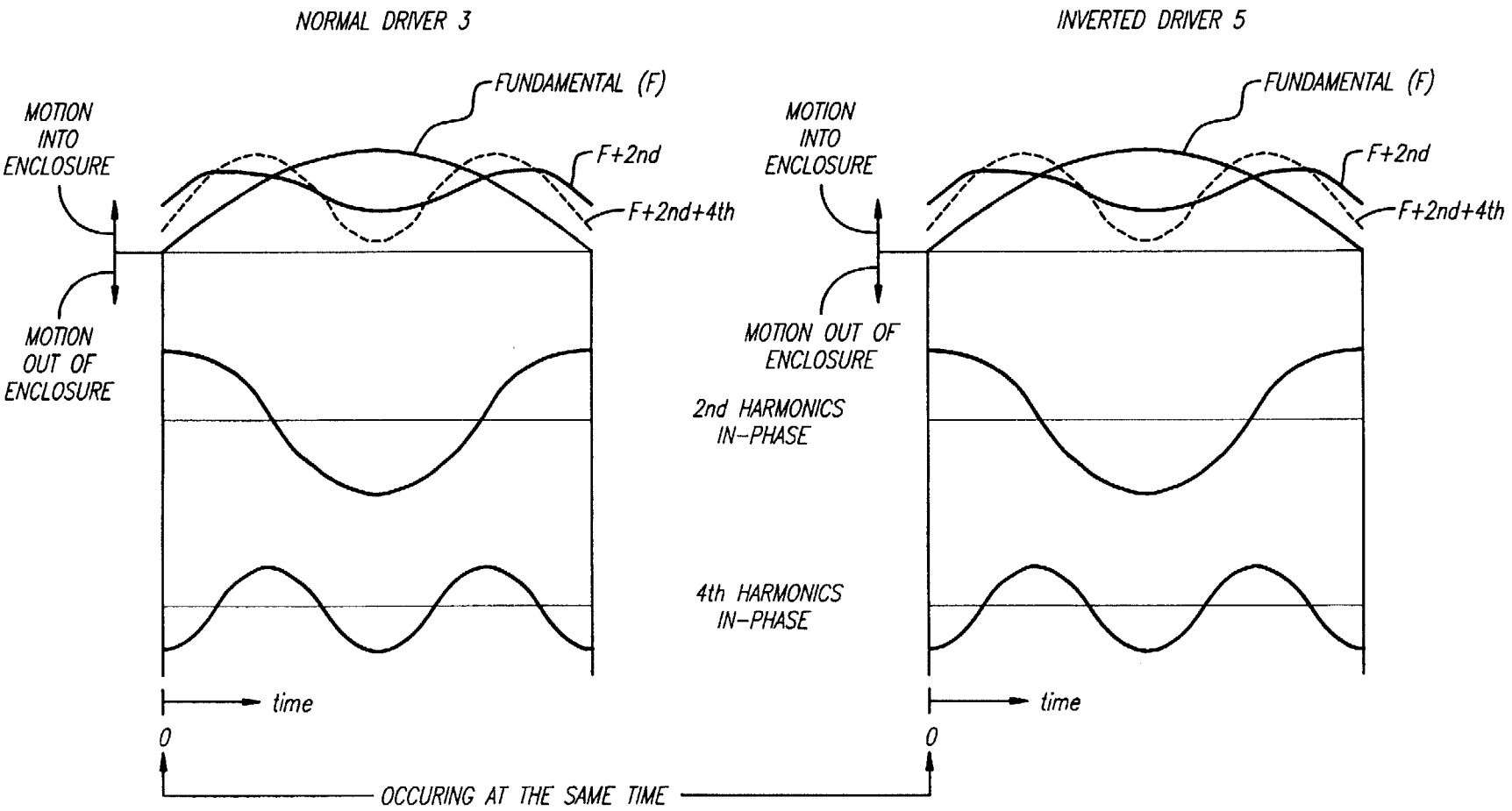
FIG. 4*e* shows in-phase even-order distortion harmonic components as between the two drivers of FIG. 4*a* for high levels of sound power, illustrating the waveform relationship during the half cycle of the fundamental having motion into the loudspeaker enclosure, and the 2nd and 4th are summed at about one half the amplitude shown in their individual drawings.
Figure 4F:
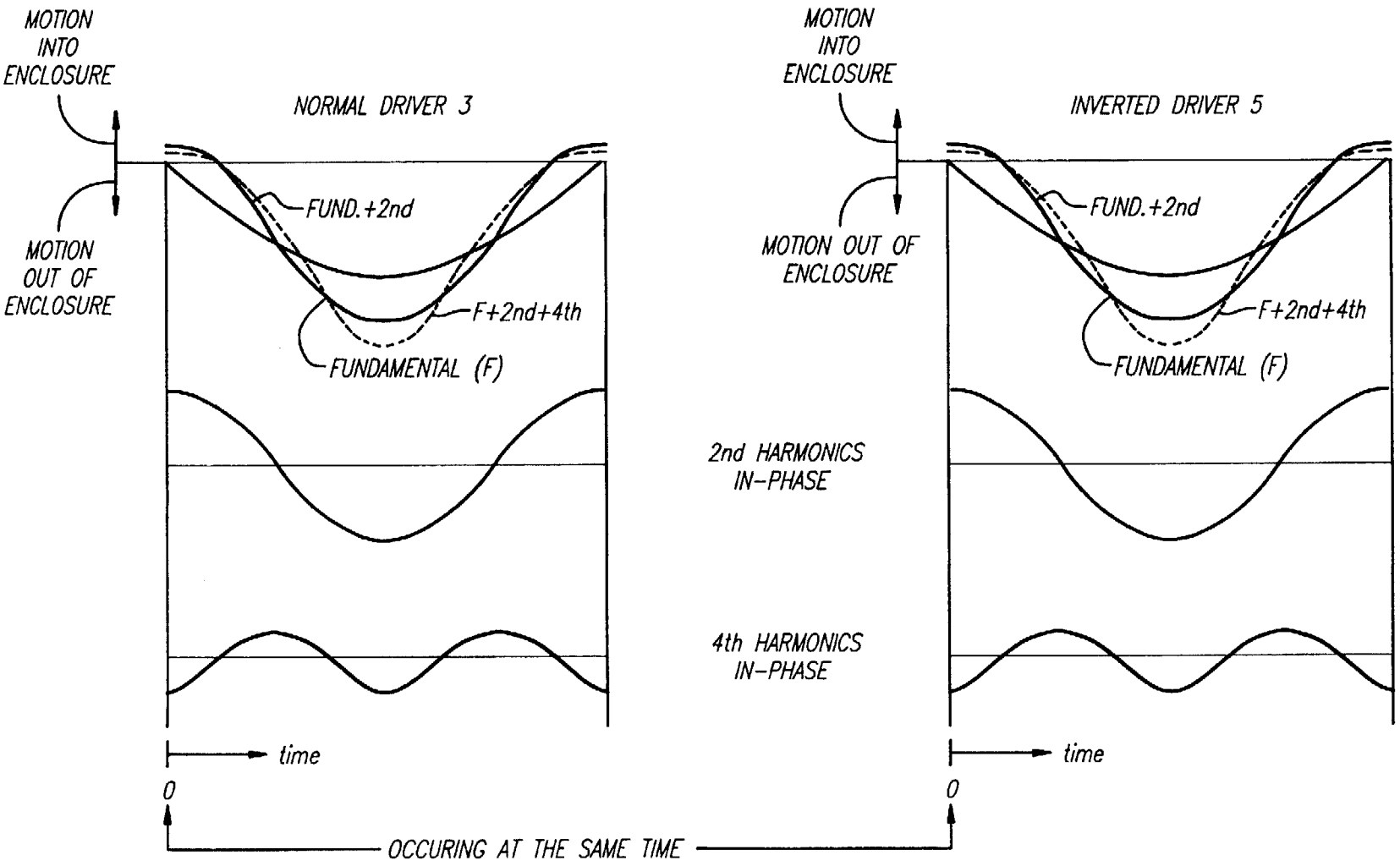
FIG. 4*f* shows in-phase even-order distortion harmonic components as between the two drivers of FIG. 4*a* for high levels of sound power, illustrating the waveform relationship during the half cycle of the fundamental having motion out of the loudspeaker enclosure, and the 2nd and 4th are summed at about one half the amplitude shown in their individual drawings.

FIGS. 4*e* and 4*f* show the more recently discovered in-phase lower amplitude even-order harmonics which only get much above 4 dB spoilage of the 4*a*–4*d* large even-orders in the highest top few dB of fundamental of which the drivers are capable (assuming a moderate, not extreme minimal cabinet volume for the drivers used).

Essential to the intent of this interlocked supplemental system, the invention does not change, or supplant in any way, the action of the push-pull system in greatly reducing out-of-phase, even-order, distortion harmonics. Rather, the invention reduces the in-phase, odd-order, distortion harmonics which become significant at medium to high sound levels. These distortion harmonics were totally unaffected by the original push-pull concept and remained as an objectionable distortion. In addition, the invention appropriately reduces, previously also unaffected, even-order but now in-phase distortion harmonics which come into being only at near the highest fundamental sound levels and which were left completely untouched by the original push-pull concept. Another important distortion, called intermodulation distortion, is also greatly reduced by use of the new system, as will be described later.

To preserve the good qualities of the push-pull system and remove other distortion, requires a signal containing harmonics in their proper phase, derivable, for example, from sensors 51, 52 (FIG. 8) on the voice coil formers 31 (an insulating cylinder) of a working push-pull type speaker system 1. With these devices, the system is effective in reducing to a usefully low level the remaining totally in-phase distortion without any impact upon the original push-pull system's acoustic "near cancellation" of out-of-phase distortion harmonics provided certain signals which would affect out-of-phase harmonics are carefully removed as will be described.

Figure 5:
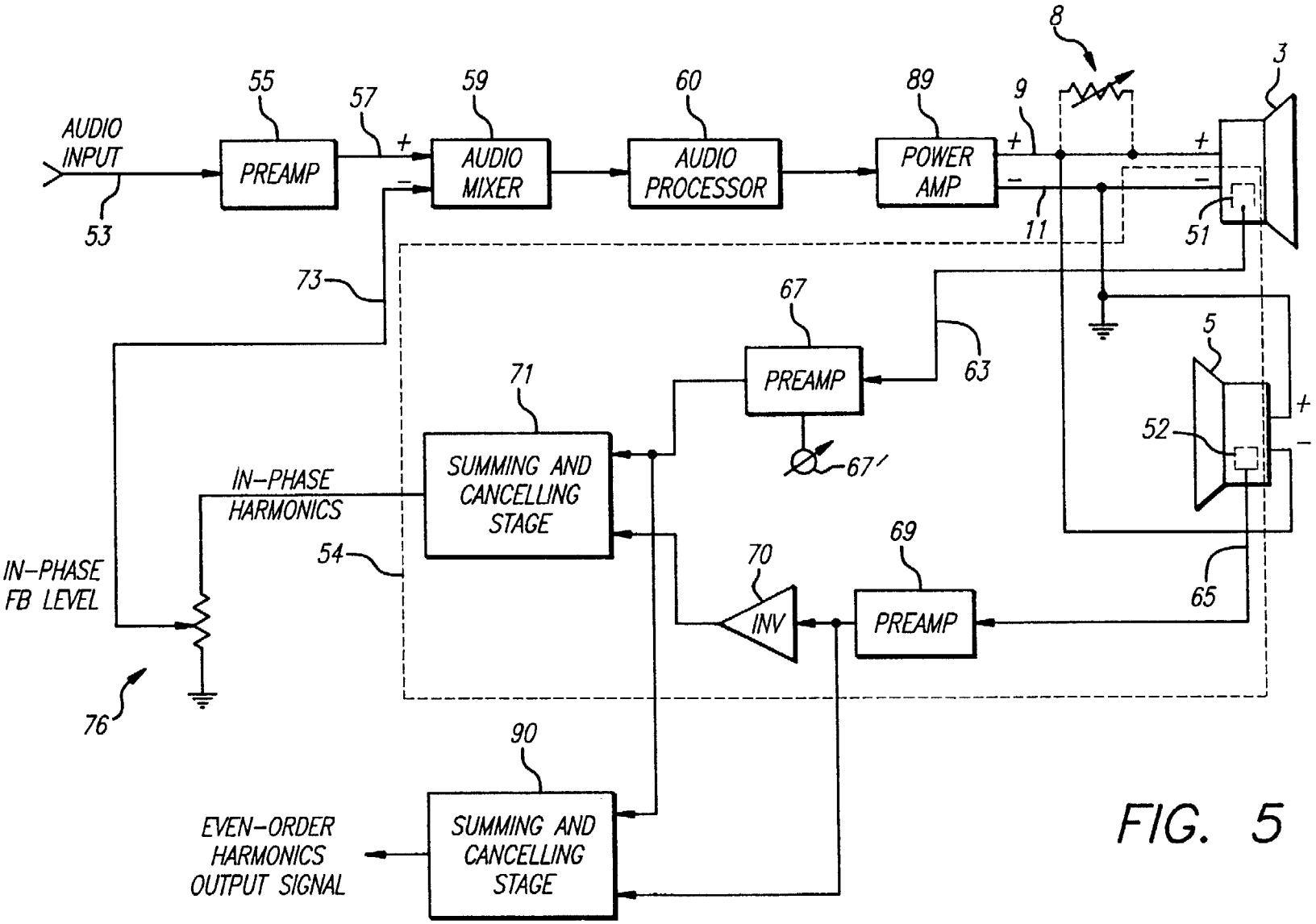
FIG. 5 is an overall block diagram of a complete loudspeaker system incorporating a power amplifier and the in-phase feedback cancellation loop in accordance with the present invention.
Figure 6:
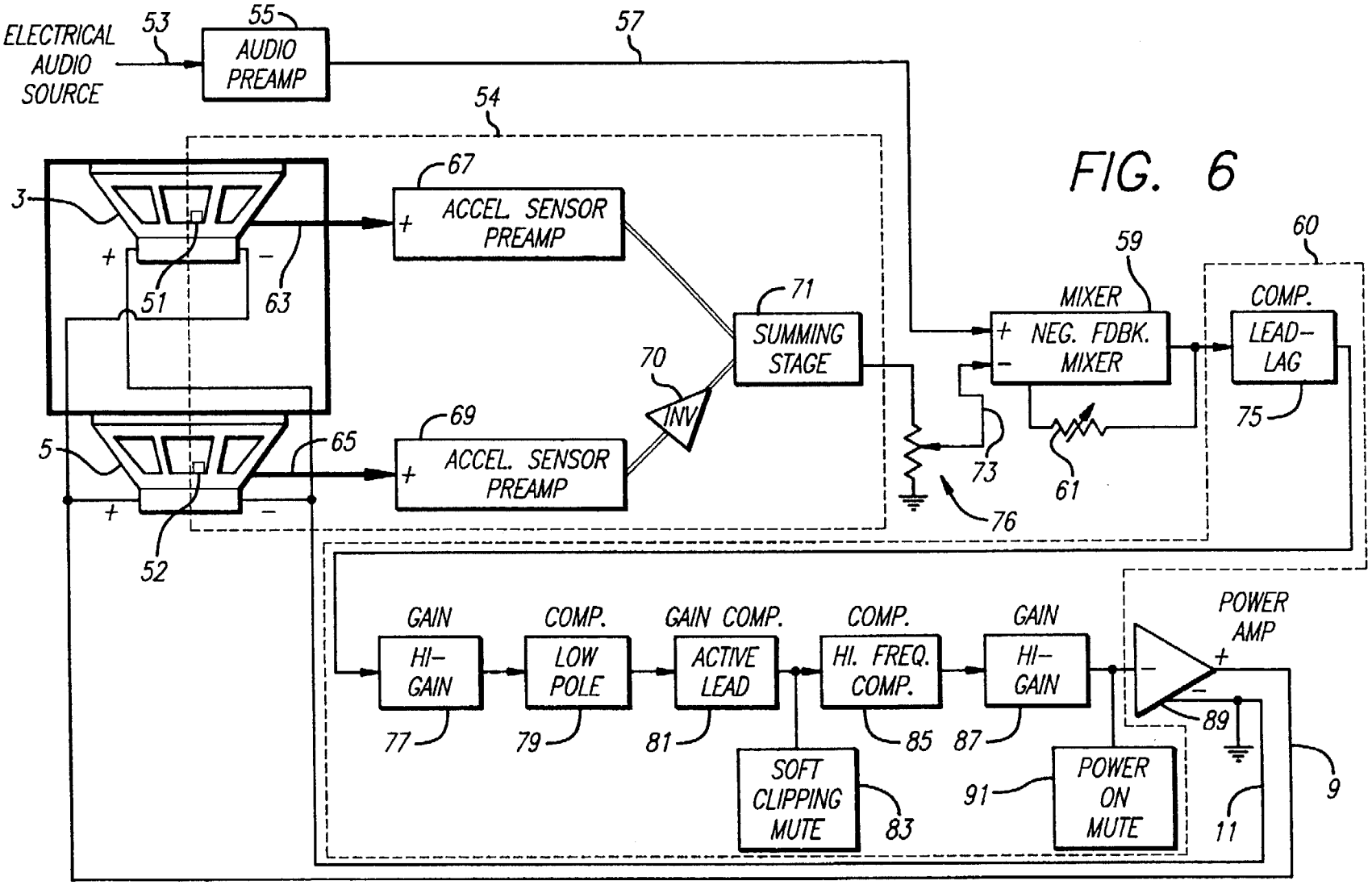
FIG. 6 is a more detailed block diagram of the overall system shown in FIG. 5.
Figure 7:
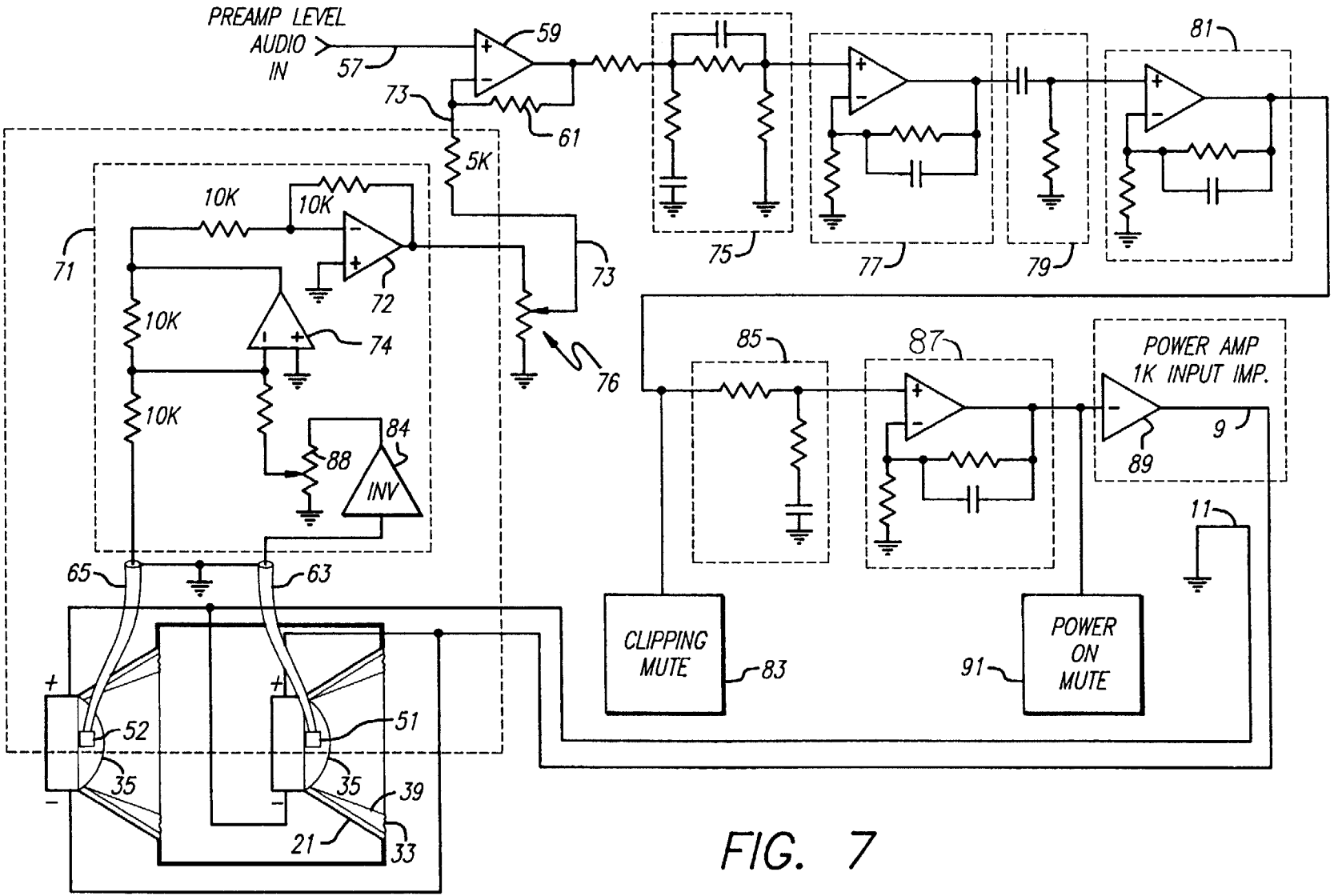
FIG. 7 is a generalized schematic diagram of the functional block diagram of FIG. 6.
Figure 10:
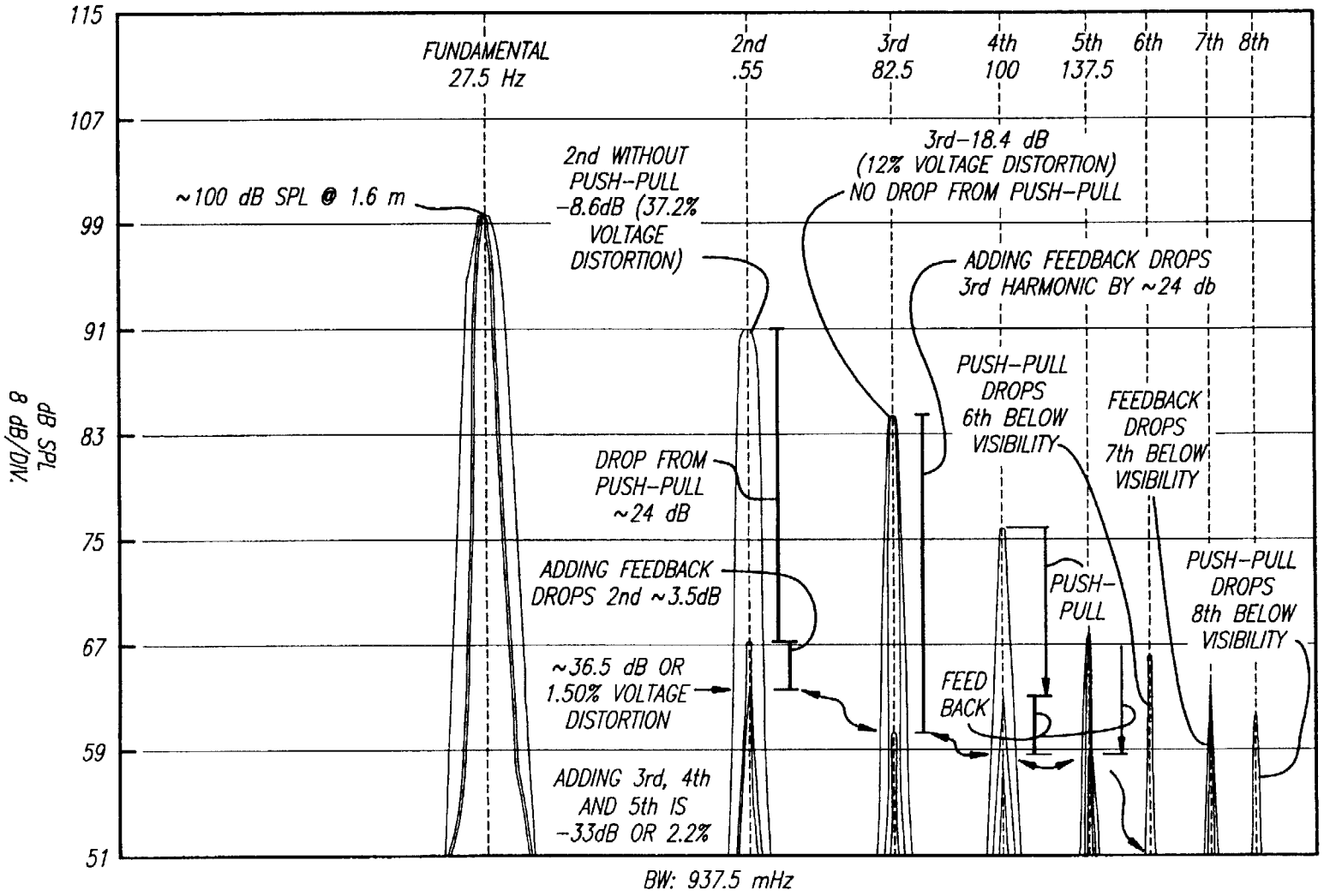
FIG. 10 shows spectrum analyzer results with push-pull working, and with and without the present invention in operation, for a moderate to high sound power level.

Looking ahead, and referring to FIGS. 5–7, the invention makes use of an electrical feedback system 51, 52, 67, 69, 70, 71, 76, 73, and 59 which derives its input signals from two inertial (or other) sensors 51, 52 mounted on what may be called the mechanical push-pull system drivers 3, 5. This allows the summing and cancelling stage 71 to cancel almost perfectly by a slight touch on the variable gain preamp 67 at final test in manufacture (although they would cancel well enough to work without the fine touch tuning since the two signals that cancel are large compared to any normal differences in the drivers and sensors manufactured to be almost identical) all out-of-phase signal content (even-order 2nd and 4th, etc. distortion harmonics and of essentially equal-amplitude) and leaves the remaining in-phase content, which does not cancel, to be used as an electrical feedback signal. FIGS. 5 and 6 are functional diagrams and FIG. 7 is a schematic of a preferred embodiment of the invention. This system has demonstrated in a variety of laboratory tests of which FIG. 10 is a fair sample 10 dB below FIG. 11 which is a very high level, only 1 or 2 dB below the maximum fundamental level the drivers used could provide and both show that the in-phase only feedback system essentially completely avoids disturbing the acoustic out-of-phase push-pull harmonic suppression system.

Returning to FIGS. 1*a*–1*c*, these figures show three different push-pull loudspeaker systems 1, of which 1*a* is the simplest at first glance but 1*b* and 1*c*, which are equivalent in performance to 1*a*, are much more often used at bass frequencies.

In FIG. 1*a*, loudspeaker driver 3 has its cone facing out of the enclosure 2, and on the same side of the enclosure, loudspeaker driver 5 has its cone facing into enclosure 2. An amplifier 7 has its positive lead 9 connected to the positive terminal of driver 3 and the negative terminal of driver 5, while the negative output line 11 of amplifier 7 is connected to the negative terminal of driver 3 and the positive terminal of driver 5. However, this arrangement of drivers is seldom the preferred form for bass because the inverted driver is difficult to disguise, and placing two large diameter drivers on a single panel makes a speaker which may be too large to be acceptable to fit into an otherwise beautifully decorated room. This may not be true for smaller speakers which handle the lower mid-range frequencies.

An alternate form of a prior art push-pull system is shown in FIG. 1*b* wherein the speaker system 1 includes an enclosure 2 having the outwardly facing driver 3 on one end of the enclosure 2 and the inwardly facing driver 5 on the opposite wall of the enclosure 2. This works almost equally as well as the configuration of FIG. 1*a*. The important directions to consider for this type of system to work are into the cabinet and out of the cabinet, not left or right or in the same room direction. The FIG. 1*b* configuration may also be better than that of FIG. 1*a* because with big diameter drivers (12, 15, or 18 inch), configuration 1*a* needs too wide a front surface for a given volume.

FIG. 1*c* shows yet a further configuration of a prior art push-pull speaker system 1 having an enclosure 2 with driver 3 having its cone facing out the front of the enclosure 2 and the inverted driver 5 mounted on the bottom wall of enclosure 2 with space underneath the enclosure being provided by legs 13 and large openings between the legs and floor to allow sound waves from the bottom driver to escape into the surrounding air space. This style also has great merit, because it is easy to provide unnoticeable or decorative skirts to prevent the inverted driver from being seen and does not require as expensive cabinetry as configuration 1*b* to hide the inverted driver.

Figure 2:
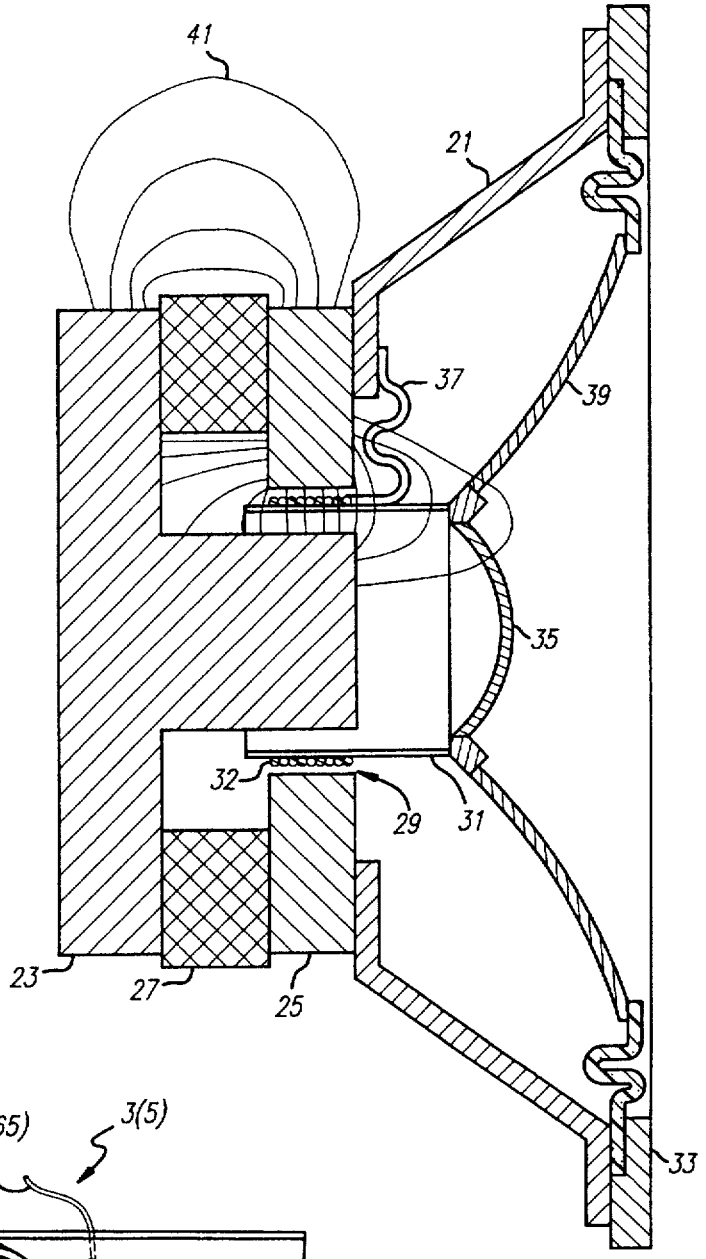
FIG. 2 PRIOR ART
FIG. 2 is a cross sectional view of a typical prior art driver.

FIG. 2 is a cutaway representation of a loudspeaker driver having a frame 21 supporting an outer pole piece 25 and a center pole piece 23 forming a gap 29 therebetween. A permanent magnet 27 is inserted between the pole pieces in the traditional fashion in order to generate a magnetic field in the gap 29 between the inner and outer pole pieces 23, 25. Also as is rather standard, a voice coil 32 is wound on voice coil former 31 and suspended in the gap 29 by means of a flexible spider 37 attached towards its center to the voice coil former 31 and at its rim to the frame 21. The cone 39 of the loudspeaker driver has an outer annular flexible ring, called a surround 33, secured to the open wide end of the frame 21, also as is commonly known in the art. Finally, a dome-shaped dust cover 35 is glued to the center of the cone above the voice coil former 31 not only to keep dust out of the gap 29, but even more important, to prevent air flow noises from getting out into the room. The frame 21 has large (not shown) openings cut into its diagonal portions which permit essentially unopposed air pressure both above and below normal to the surrounding air (which results in radiated sound).

Figure 3A:
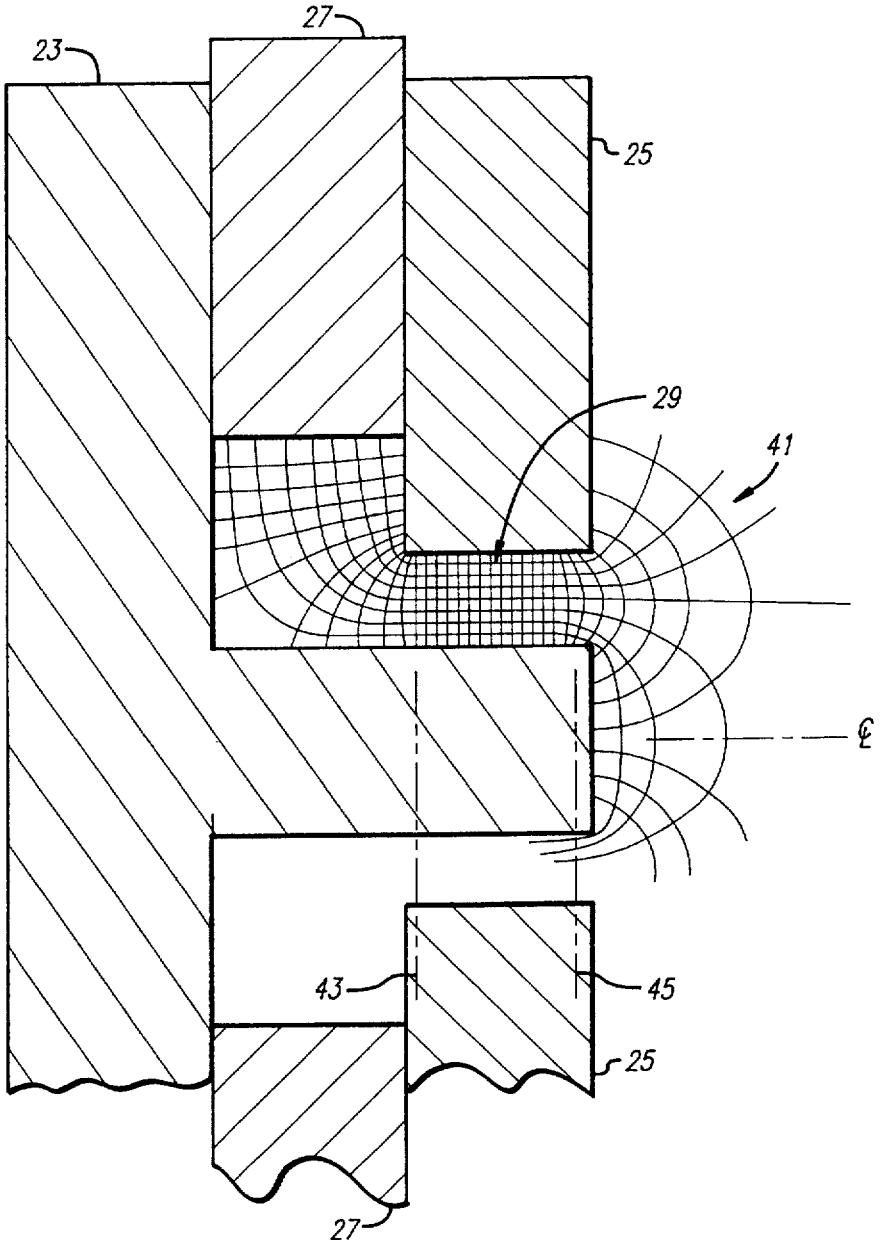
FIGS. 3*a* and 3*b* show the magnetic field distribution in the gap between the outer and inner pole pieces of a typical prior art driver, and the magnetic field intensity B vs. voice coil position characteristics in graphical form.
Figure 3B:
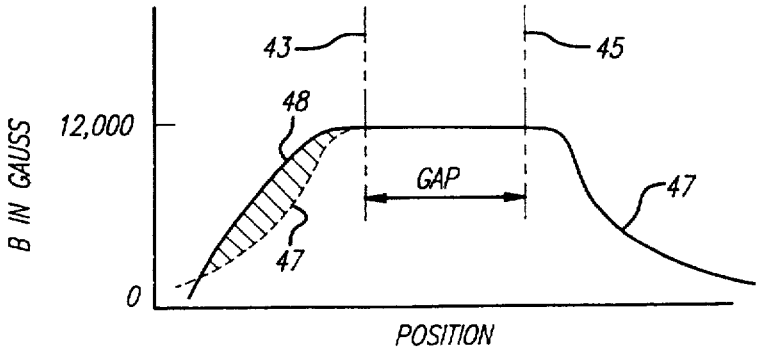

To aid in the understanding of the deficiencies of prior art loudspeaker systems and to appreciate the beneficial effects of the present invention in accounting for such deficiencies and compensating for them, FIGS. 3*a* and 3*b* may be referred to from time to time so as to relate the physical description to follow with a representation of the magnetic field strength in the gap 29 of a typical loudspeaker driver. FIG. 3*a* depicts the lines of magnetic field 41 in the gap 29 and at the ends of the gap 29. Only at the center approximately 85% to 95% of the gap along the axial thickness of outer pole piece 25, is the magnetic field strength uniform. If a voice coil 32 (cf FIG. 2) is confined within the uniform region of gap 29, the voice coil and cone movement of the driver would be predictably proportional to the applied current, creating a force on the voice coil 32 which would be sinusoidal if the applied current was sinusoidal and of relatively low amplitude. As a result, a linear transformation function between the input driving signal and the output sound from cone 39 would be devoid of any distortion created by the driver itself. However, as is commonly known, when portions of the voice coil 32 are moved out of and into the gap by even moderate voice coil excursions, it is obvious that the audio frequency force created by the current in voice coil 32 reacts with the permanent magnetic field 41 in the gap 29 of the driver in a non-linear fashion, because the permanent magnetic field drops in intensity near and just outside both ends of the gap and somewhat differently, with the field being stronger in the toward-the-magnet end, and dropping more quickly and therefore progressively weaker at its away-from-the-magnet end. It is this non-linear relationship that contributes significantly to the distortion harmonic effects in the sound emanating from the cone. To illustrate this graphically, FIG. 3*b* shows the magnetic field strength B along the center line of the gap 29 versus possible positions of wire turns of the voice coil 32 in the gap 29, the very uniform field limits in the gap being shown by dashed lines 43 and 45, and the graphical representation of the magnetic field intensity shown as a solid line 47.

The shaded area 48 of FIG. 3*b* represents the difference in magnetic field strength between the open and closed ends of the gap 29. That is, the solid graph line represents the actual field strength measured along the gap. The dashed line is a mirror image of the field strength at the open end of the gap. The shaded area is then the difference. This asymmetry of field strength, illustrated by shaded region 48, means that when both voice coils 32 of drivers 3 and 5 are moved away from their positions in the center of the gap, part of one voice coil 32 experiences the magnetic field gradient shown at the right in FIG. 3*b*, while part of the other experiences the field gradient shown at the left of FIG. 3*b*. As a result, at medium to moderately high and even to the highest sound levels, the peak levels of the half roughly sine waves being produced are not equal (due to the non-symmetry of the magnetic fields experienced by the two drivers). In the next half wave, the two drivers will switch roles, the larger peak level becoming the smaller and vice versa.

A larger followed by a relatively smaller half wave of cone motion indicates even-order harmonics being produced by each driver, but the sum of both out in the room is almost zero difference from a wave with very little even-order harmonics (typically, this acoustic push-pull cancellation in the air around the speaker lowers the 2nd and 4th harmonic components 24 dB and 14 dB, respectively, more than without push-pull); only 14 dB from the 4th harmonic because it starts already 24 dB down from the fundamental due to its lesser contribution needed for the wave shape from the asymmetric magnetic field. However, the combined wave is still different than those a perfect sine wave would have even when they add in space. The two summed waves with a not perfect sine wave but symmetric top half to bottom half shape are still distorted by odd harmonics. (Theoretically, a top and bottom squared off sine wave can be made of purely odd harmonics.) The major remaining distortion from a sine wave shape is from forces on the moving voice coil and cone system that are symmetrical but not linear with amplitude such as the supports of the moving system, notably the cone surround 33 and the voice coil support called the spider 37, as well as the symmetric component of the dropoff of the gap magnetic field 41.

Before further describing the details of construction and operation of the invention, some background information will be presented having reference to FIGS. 2, 3, and 4*a*–4*d*.

In FIGS. 4*a*, 4*b*, and 4*c*, waveforms 10 and 12 represent, respectively, both the fundamental driving signal and the fundamental cone excursions of drivers 3, 5 over time for one cycle of a fundamental waveform. Since when cone 39 of driver 5 is moving out of the cabinet 2, its voice coil is moving partially out of its gap toward its magnet, thus experiencing the stronger of the two decreasing out-of-gap magnetic fields. Accordingly, as the driving force reaches its lower peak (because the controlling force comes from the smaller level of increasing current proportional to $1/B^2$). (See the material earlier in this document in the section "Brief Description of the Prior Art" and the subtopic "In-Phase, Out-of-Phase, Odd-Order, Even-Order Considerations" discussing H. D. Harwood and the $1/B^2$ effect.)

On the second half cycle of the input fundamental waveform 10, driver 5 is driven to cause its cone to move out of the gap and away from its magnet experiencing in this half wave the weaker of the decreasing fields and the driving force reaches its highest peak, because the current goes up proportional to $1/B^2$, and the input fundamental waveform 10 is seen to be modified in the second half cycle of the waveforms for driver 5, to wit, a large into-the-cabinet peak. The 2nd harmonic is shown in exactly the phase which puts the lower peak and the higher peak in their correct order as is shown throughout FIGS. 4*a*–4*c*. The 4th harmonic and further even-order harmonics are necessarily set up in smaller and smaller amounts to fit the unsymmetrical wave shape the spatial situation has produced.

Exactly the reverse situation occurs for driver 3 in which the out-of-the-cabinet motion is toward the weaker gap edge field which becomes the large half-wave 16. The waves drawn along the edge of the cones in FIG. 4*a* show the correct motion versus time also.

Mathematically, the flattening out of one half cycle of a waveform and a peaking of the other half cycle can be modeled by the algebraic sum of a fundamental waveform and its second harmonic component shown, respectively, as waveforms 10 and 18 for the waveforms of driver 5 and as waveforms 12 and 20 for the waveforms for driver 3. It should be understood that waveforms 14 and 16 reflect only the summation of a fundamental and its second harmonic out-of-phase component, and, from a practical viewpoint, the "flat" portions of cone movement will typically be flatter than depicted. The waveforms of FIGS. 4*a*–4*c* are thus simplified to show that the out-of-phase 2nd harmonic component of driver 3 is exactly 180° out of phase with the 2nd harmonic component of driver 5. Thus, although each speaker individually produces 2nd harmonic out-of-phase distortion components, the fact that the sound sources of drivers 3 and 5 are in close proximity compared to a wavelength of the sound frequency being radiated (in the same speaker cabinet), the out-of-phase 2nd harmonic (and all substantial even harmonic) components will acoustically cancel each other to a great extent as they move out into the air space around the total speaker. From FIGS. 4*b* and 4*c* then, it can be appreciated that the two fundamental in-phase sine waves acoustically add to reinforce one another in producing sound waves out into the room outside the enclosure 2, and the out-of-phase 2nd harmonic (and other even harmonic) distortion components will acoustically almost cancel. This is the basic principle of the push-pull system.

As is consistent in this description, driver 3 is always described as having its cone facing (concave side) out of the enclosure 2, while driver 5 has its cone facing into the enclosure 2. Thus, when the motion of the cones for both drivers 3 and 5 are out of the enclosure (the cones of FIG. 4*a* moving just like the fundamentals of 4*b* and 4*c* as drawn), the inverted driver 5 has a flattening out of the cone motion at the positive peak of the drawn fundamental in the figures, while the cone motion of the normal driver has a peaking of the cone motion waveform, and visa versa. This is illustrated in the waveforms A of FIG. 4*d*. As in FIG. 4*a*, the 2nd harmonic out-of-phase components are shown isolated in waveforms B of FIG. 4*d*. The 3rd distortion harmonic waveforms C in FIG. 4*d* are in-phase (to be discussed later) , and thus do not acoustically cancel outside the enclosure. The 4th distortion harmonics are also out-of-phase as between the two drivers and will acoustically cancel as previously indicated. Finally, FIG. 4*d* also shows the 5th distortion harmonics which are also in-phase as between the two drivers 3, 5 and, again, do not acoustically cancel outside of the enclosure. The 3rd and 5th harmonics are shown just to illustrate that they are in-phase as between drivers 3 and 5 and their cause and levels are discussed separately. The need for cancellation of the odd harmonics is thus evident from these figures, and this cannot be done acoustically by the traditional push-pull system. The present invention, however, solves this problem.

FIG. 4*d* graphically illustrates the phase relationship between a fundamental and some of the distortion harmonics, particularly the 2nd and 4th. However, the in-phase 3rd and 5th are there only to show their relationships to harmonics which do cancel. They are shown again in FIGS. 4*g* and 4*h* relating to cone movements from other causes.

Figure 4G:
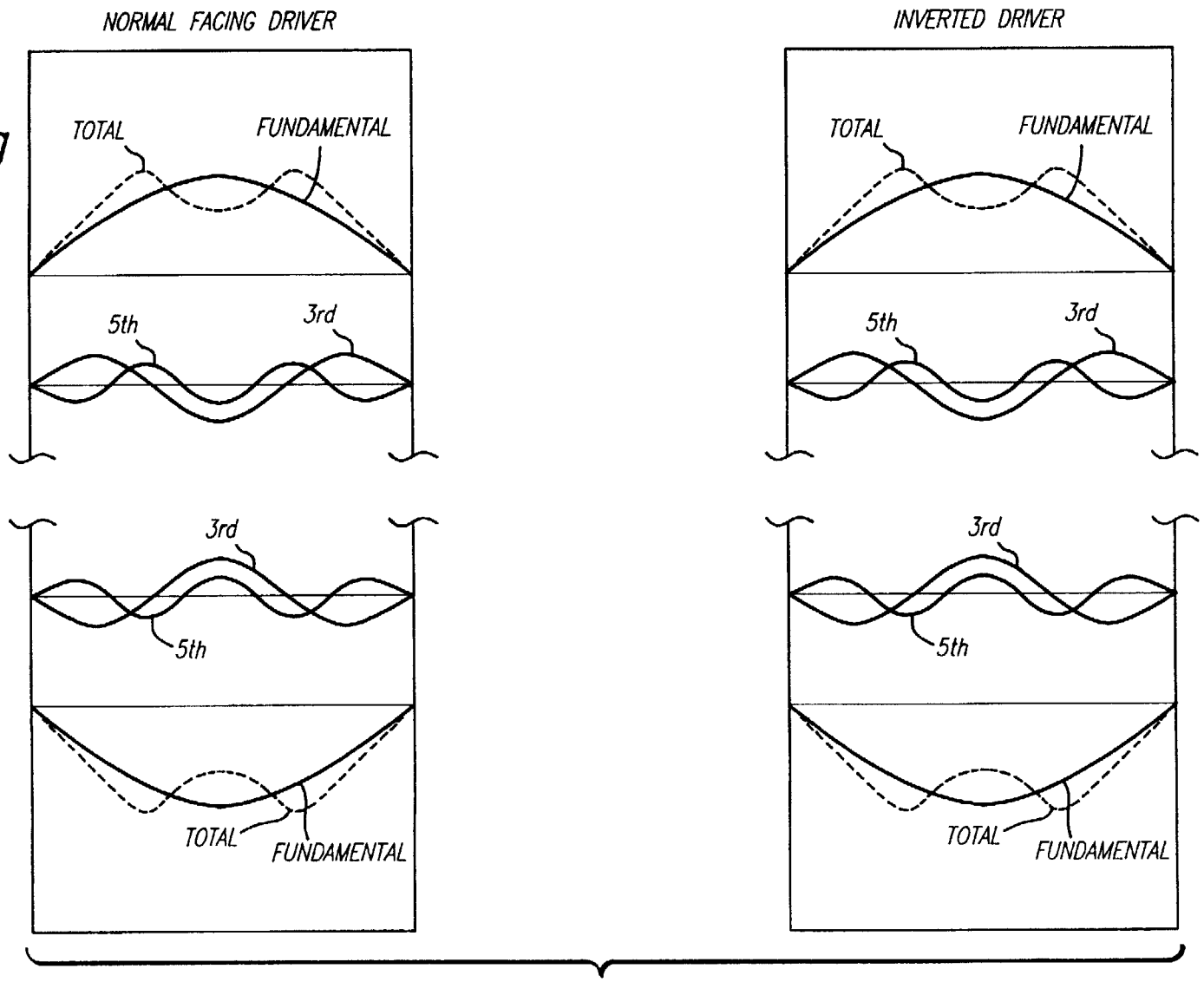
FIG. 4*g* illustrates in-phase odd-order distortion harmonics, as between the two drivers, of FIG. 4*a* with the 3rd and 5th harmonics in a relationship with the fundamental to produce a flattened resultant wave motion at both maxima, and the 3rd and 5th are summed at about one half the amplitude shown in their individual drawings.
Figure 4H:
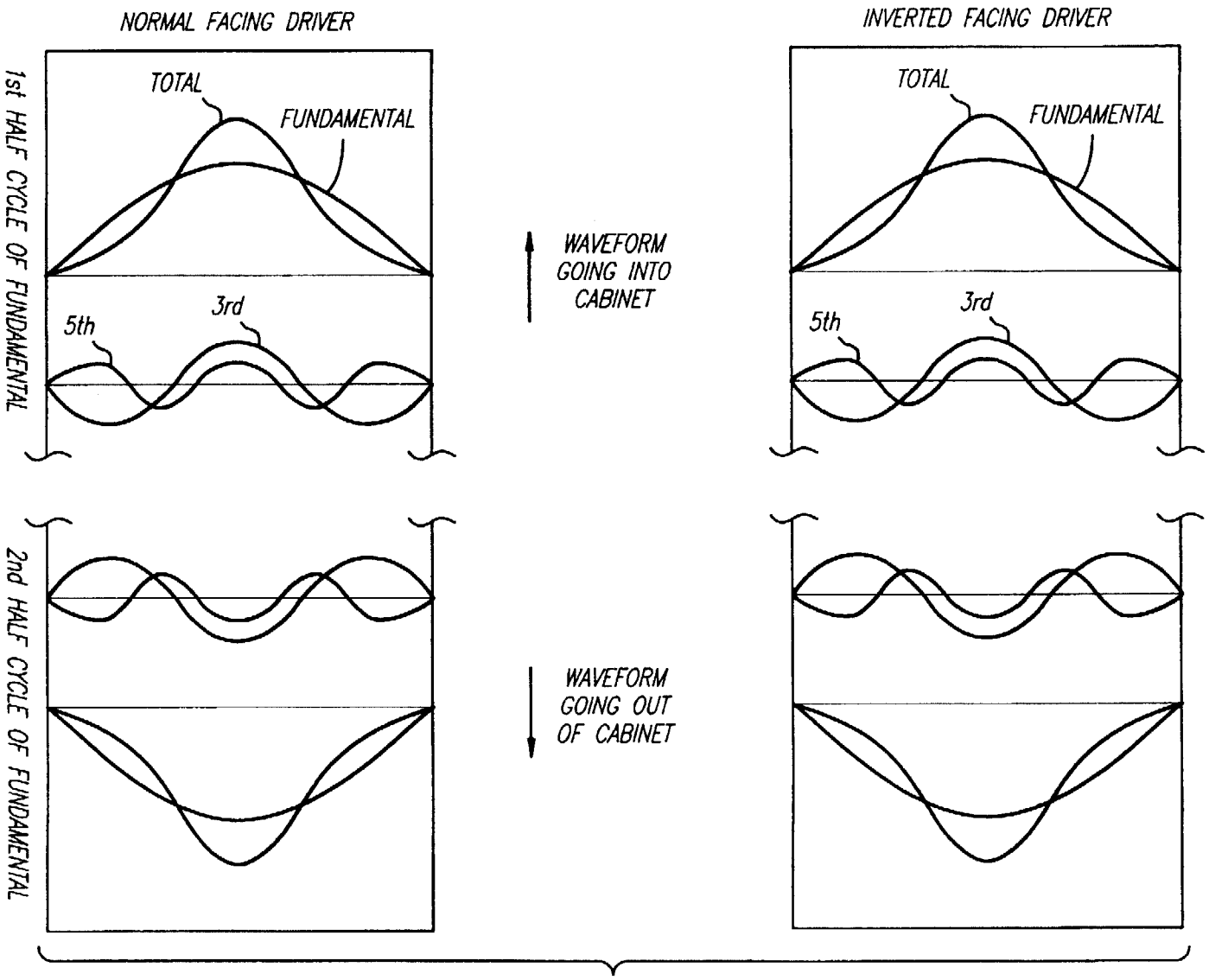
FIG. 4*h* illustrates in-phase odd-order distortion harmonics as between the two drivers of FIG. 4*a* with the 3rd and 5th harmonics in a relationship with the fundamental to produce a peaked resultant wave motion at both maxima and the 3rd and 5th are summed at about one half the level at which they are shown individually.

However, as explained infra, with one notable exception, at higher audio levels, approaching the highest levels at which the drivers are capable of reproducing sound, both drivers cannot easily push in to their furthest deep position (in-phase) at the same time against the pressure of air compressed by them in the cabinet, and this produces even-order but in-phase distortion harmonics graphically illustrated in FIGS. 4*e* and 4*f*. Here, the 2nd and 4th distortion harmonic components are in-phase as between the two drivers (compare with out-of-phase waveforms B and D in FIG. 4*d*). Here also, since the 2nd and 4th distortion harmonic waveforms are in-phase (at very high levels), these distortion harmonic components, even though of even-order, do not acoustically cancel using only the standard push-pull loudspeaker arrangement. Although in cabinets of reasonable volume (for the low frequencies and high amplitudes desired), these harmonics do not reach comparable amplitudes to those of the out-of-phase even-order distortion harmonics which are, as previously described, acoustically lowered by the order of 24 and 14 dB, for example, the new in-phase even-order distortion is easily suppressed by the same mechanism found satisfactory for solving the major remaining problem, the major in-phase moderately high level odd-order distortion harmonics (FIGS. 4*g* and 4*h*). The distortion harmonic characteristics shown in FIG. 4*g* could occur, for example, due to the limiting or flattening of the tops of the waveforms which can highly non-linearly occur at the stretch limit of the surrounds and spiders. The distortion harmonic characteristics shown in FIG. 4*h* could occur earlier, for example due to the falloff of the permanent magnet field at both ends of the gap, as interpreted by the more sophisticated reasoning of H. D. Harwood. The cone movement rises as shown in FIG. 4*h*, symmetrically at both ends of its excursion from the generally symmetrical dropoff in field at both ends of the pole piece (magnetic field) gap leading to odd-order harmonics as seen in FIG. 4*h*.

In any event, whether it is peaking or flattening type of a distortion is of no consequence to the function of the invention which operates based on symmetry or absence of symmetry with respect to the amplitude of the disturbance from a sine wave.

FIG. 5 is a general block diagram of the overall system incorporating the present invention, this figure showing the components of the system in broad functional blocks. Basically, an input audio signal to be converted to acoustic energy in drivers 3, 5 is introduced on line 53 to an audio preamplifier 55 (if necessary for level of the signal) whose output, on line 57, is applied to the plus input of an audio mixer 59. The output of audio mixer 59 is applied through an audio processor 60, which optimizes the signal by phase compensation, pole distribution, gain compensation etc., as is customary by those skilled in the art for a moderate gain feedback system to enhance the stability in the frequency domain and in gain. The output of processor 60 is coupled to a power amplifier 89 which drives the loudspeaker drivers 3, 5 on lines 9, 11. Sensors 51 and 52 are inertial (or other equivalent) sensors, sensing the inertial/acceleration characteristic movements of the voice coil of each loudspeaker driver 3, 5, respectively.

Figure 8:
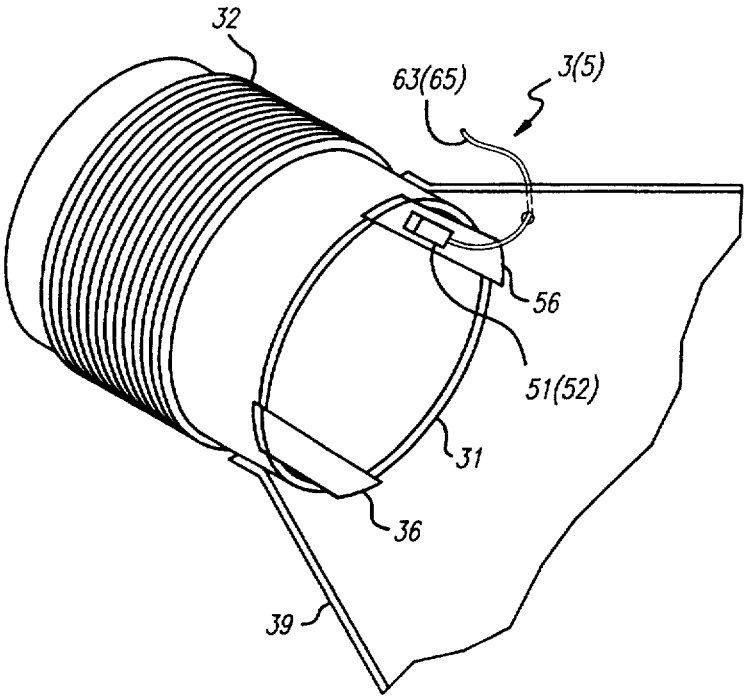
FIG. 8 is a cutaway view of a loudspeaker driver showing the mounting position of the inertial sensor employed by the present invention.

FIG. 8 shows the physical placement of inertial sensors 51, 52 on voice coil formers 31 mounted securely on aluminum bridges 56, under the dust caps (not shown in FIG. 8), the sensor wire leads 63, 65 (preferably thin flexible coaxial cables appropriately shaped to allow flexing for very long periods of time, as is known in the art), passing through the respective cones 39 to an appropriate connector device on the drivers' frames (not shown) from where a coaxial cable (stable, not flexible) can lead to the two preamplifiers and all other appropriate mixers, processors, amplifiers, etc. as on FIG. 5, FIG. 6, FIG. 7, or FIG. 14 executed with appropriate components on shielded printed circuit board generally mounted in the cabinet on a back plate shielded power supply with power transformer and power amplifier with good heat conduction to finned external heat dissipators all to U.L. standards Sensors 51, 52 may be selected from a number of available commercial sources. A suitable sensor for this purpose is Accelerometer ACH-01 available from Pennwalt Corporation, Kynar Piezo Film Department, P.O. Box 799, Valley Forge, Pa. 19482. Another suitable sensor may be the monolithic accelerometer with signal conditioning, Model No. ADXL50 available from Analog Devices, 1 Technology Way, P.O. Box 9106, Norwood, Mass. 02062-9106 or similar competitive devices to these.

Each bridge 56 is fastened to its respective voice coil former 31 with high temperature cement. See FIG. 8. The sensor 51 or 52 is similarly fastened to the aluminum bridge 56, preferably near one of the ends of the bridge 56 which rests on the voice coil former 31. The bridge 56 may be placed anywhere from an arc of the edge of the former 31 of voice coil 32 to the center of the former 31, depending on possible interference with other driver members and greatest mechanical stability. An equal weight 36 can be mounted diametrically opposite bridge 56 for balance. Both bridge 56 and weight 36, if used, should overlap the outer edge of former 31 so as to provide for adhesion by the cement on both surfaces of former 31.

Referring back to FIG. 5, the outputs of sensors 51, 52 are applied through coaxial cables 63,65 to a pair of preamplifiers 67, 69, respectively. One preamplifier output, actually either one, but in this embodiment preamplifier 69, routes its output to a unity gain inverter amplifier 70. Almost perfect cancellation of out-of-phase evens comes from preamplifier 67 having a gain control to vary its gain from slightly less to slightly more than preamplifier 69 and its inverter 70 (all of which are easily accomplished by any engineer or craftsman skilled in the art). This balance can be done at final test. The outputs of preamplifier 67 and inverter 70 are summed in the summing and cancelling stage 71 whose output is applied through a potentiometer 76, functioning as an IN-PHASE FEEDBACK LEVEL control, to the negative input of audio mixer 59. Alternatively, a gain control normally included in the mixer stage 59 may be used to accomplish this function of setting the magnitude of negative feedback used to decrease certain types of distortion as previously described.

The two drivers 3, 5 in FIG. 5 are shown facing in opposite directions to illustrate the manner in which a normally mounted driver 3 has its cone facing out of the enclosure and an inverted driver 5 has its cone facing into the enclosure, this being representative of several standard push-pull mounting arrangements, such as FIGS. 1*a*, *b*, and *c*. Since the two drivers 3, 5 should be nearly identical in construction and electro-mechanical characteristics, it is also recommended that the sensors 51, 52 be mounted identically on their respective drivers. In this way, a defective driver can be replaced by a new driver without concern as to the mounting orientation of its sensor. Of course, if desired, nearly identical drivers with sensors 51, 52 mounted in opposite orientation can be used in the implementation of the present invention, the only difference being that, for identical drivers 3, 5, a unity gain inverter amplifier 70 is installed in the system, whereas drivers with oppositely oriented sensors may be employed without the need for an inverter 70.

Assuming that sensors 51, 52 are mounted in identical fashion on each driver, it will be appreciated that, since the cones of drivers 3, 5 move out of the enclosure together with one cone facing backwards and into the enclosure together, by the fundamental input waveform and its natural sound harmonics, all because drivers 3, 5 are moved oppositely with respect to their magnets, sensor 51 will sense the opposite directional acceleration of its voice coil relative to the magnet of driver 3 from that sensed by sensor 52 relative to the magnet of driver 5.

But that is precisely the case when it is proper for the sensors to add their signals in the summing and cancelling stage 71. For negative feedback to function, the feedback loop needs all the fundamentals plus all the in-phase harmonics, both natural sound and distortion. Those come off the front of one cone and the back of the other moving together, outward or inward. So an inverter stage is provided in the output line of one sensor so all these signals will add when later combined. The out-of-phase distortion harmonics (generally containing the single largest distortion harmonic, the 2nd order) will then be the only signals that cancel and that come off the two cones out into air space in opposite phase from the front of one driver and the back of the other and therefore do not need feedback.

The outputs of preamplifiers 67, 69, then, for distortion reduction by feedback, are electrically 180° out of phase from one another. By providing a unity gain inverter amplifier 70 in one of the paths, for example as shown in the path of the output of preamplifier 69, the inputs to summing and cancelling stage 71 are identical and therefore add together. The output of summing and canceling stage 71 is then applied through the in-phase feedback level control 76 to the minus input of audio mixer 59. Preamplifier 67 should have a variable gain control 67' for gain slightly above and below preamplifier 69 to balance out all out-of-phase harmonic distortion at a final electrical test position at the manufacturer.

Again, in a distortion reducing feedback system, the negative feedback on line 73 will have the effect of moderately lowering the level of the output of audio mixer 59 which receives the audio input signal on line 57 at its plus input terminal, such signal being routed from the audio input 53 through preamplifier 55. Thus, in this in-phase distortion reducing feedback system, the audio input signal on line 53 will be reproduced by the drivers 3, 5, and the in-phase signal detection subsystem 54 functions as it would in an ordinary feedback system, except that it will be essentially inactive to all out-of-phase distortion signals. Also, the input audio signal on input line 53 will be processed in the usual manner and put out to both loudspeaker drivers 3, 5 in the normal fashion without any alteration due to feedback except for a gain reduction which can be made up in preamp 55 as is customary in implementing distortion reduced feedback, and the only distortion reduction signals put out to the loudspeaker drivers will be those which reduce in-phase distortion generated by the two drivers (or in the amplifier, processor, mixer chain which is usually negligible).

In order for the circuit of FIG. 5 to not interfere with the normal operation of the push-pull system to cancel out-of-phase distortion harmonics, FIG. 5 will now be analyzed with this objective in mind. When the loudspeaker system exhibits its basic even-order (2nd, 4th, etc.) out-of-phase distortion harmonic characteristics at all levels from medium to and including the very highest, as detailed earlier in this description, the outputs of the two sensors 51,52 are equal and in-phase because of the relative inverted mounting of the two drivers. However, one sensor output (from sensor 52, for example) can be inverted by inverter 70, thereby producing equal but 180° out-of-phase signals at the input to summing and cancelling stage 71. These two sensor derived harmonic component signals are thus cancelled at the summing and canceling stage 71 so that no signal representing out-of-phase distortion harmonics, as between the two drivers, is routed to the minus input of audio mixer 59. In this way, the out-of-phase distortion harmonics, as between the two drivers 3, 5, radiate into space and acoustically cancel, unaffected by any effects of the electronic feedback system.

For the in-phase 3rd, 5th, etc. distortion harmonic components, and to an important degree only at very high fundamental levels, the in-phase 2nd, 4th, etc. distortion harmonic components, as explained earlier, the feedback system must significantly reduce, these components. The analysis of in-phase distortion components is almost but, importantly, not quite the same as the analysis considering the audio input signal being processed through the system. That is, any in-phase distortion harmonics sensed by sensors 51, 52 will produce equal and opposite acceleration signals on lines 63 and 65 (because of the relative inverted direction mounting of the two drivers 3,5), but due to the inversion in inverter unity gain amplifier 70, these signals add at the input of summing and canceling stage 71 and are coupled to the minus input of mixer 59. The difference between analyzing in-phase distortion harmonic components and the operation of the system for the throughput of the audio input signal lies in the fact that, at the input of audio mixer 59, there is a signal on the plus input terminal which matches the fed-back input signal through in-phase signal detection subsystem 54, while for in-phase distortion harmonic components created by the drivers 3, 5, no such corresponding match exists at the plus input terminal of mixer 59. For example, if the throughput gain of the system, without feedback, is $A_1^2$, and the feedback attenuation factor through subsystem 54 is $1/A_1$, then it can be observed that the audio input signal is passed through to drivers 3, 5 with a gain of $A_1$, while the in-phase distortion harmonic components pass through the amplifier stage with a gain of $1/A_1$, and one of the goals of the invention, i.e. to significantly reduce only in-phase distortion harmonic components electronically, is realized. An analysis which shows the above amplifications and reductions is given later in this document.

FIG. 6 is a more detailed block diagram of FIG. 5, and FIG. 7 is a generalized schematic diagram of the block diagrams of FIGS. 5 and 6. In FIG. 6, the inversion of one of the sensor signals 65 is performed in inverter block 70, while the comparable component in FIG. 7 is inverter 84, both of these inverters performing the same function as inverter 70 described earlier in connection with FIG. 5. In FIG. 6, preamplifier 67 should have a variable gain control to allow balance between 67 and 69 to cancel out-of-phase output to stage 71. In FIG. 7, a potentiometer 88 gives the factory an adjustment to make in order to precisely equalize the outputs from the two sensors 51, 52. Not all of the components of a complete system are shown, and the values of the components that are shown are not given. For example, the summing .resistors connected to the negative input of op amp 74 may advantageously be a value other than 10K ohms, e.g. one 10K and one 8K. It is within the knowledge of one skilled in the art to apply off-the-shelf components and assign component values to effect the functions of the different functional blocks in audio signal processor 60 which includes a phase compensation lead-lag network 75, a high gain stage 77, a low frequency pole network 79, a high frequency gain compensating amplifier 81, a high frequency gain compensating network 85, and a high gain amplifier 87 serving the standard power amplifier 89. A clipping mute circuit 83 is connected between gain compensator 81 and high frequency gain compensation network 85 to mute the signal applied to the power amplifier in case of clipping of the signal, i.e. if the signal at that point exceeds certain prescribed amplitude limits. Finally, a power-on mute circuit 91 holds the input to power amplifier 89 to ground while the system is powered up in order to temporarily keep any transient signal from reaching the loudspeaker, until the system is stabilized. Clipping mutes and power-on mutes are generally fashioned to each manufacturer's own desired response characteristics. They may also be found in solid state device manufacturers' handbooks, so there is no need to identify these circuits here. In any event, they have no influence on the tasks performed by the devices and their functions in this specification.

The electrical feedback system just described greatly reduces or eliminates the in-phase distortion harmonics (mostly the odd-order harmonics), as well as the in-phase distortion only (i.e. not from a signal at the audio in terminal 57) parts of any other mechanical motion that may occur in the driver's voice coil 32 and cone 39 motion. Odd-order distortion harmonics may be caused by an increase of the peaks of the sine waves of motion of each fundamental frequency due to the symmetrical part of the decreased magnetic field 41 which the voice coil 32 encounters when it goes partially out of the gap moving both outwardly and inwardly, and at slightly higher excursions the limiting of the distance each voice coil and cone can move out and in, due to the limit of stretching the cone's flexible supports (i.e. the outer cone surrounds and spiders), which limits often turn out to be almost in-phase (i.e. occurring at the same time in both drivers). Then, a combined feedback signal from both drivers sent through one amplifier chain and one power amplifier effectively greatly reduces this distortion. Any out-of-phase parts which may arise will, of course, be reduced or eliminated (to the extent that they are of equal amplitude, which is usually the case), by cancellation in air of the acoustic waves radiated by the driver cones.

Out-of-phase signals are kept from entering the feedback loop because the drivers 3, 5 are of essentially similar size and design, and the sensor and electrical signal system is designed to allow signals developed by equal but opposite direction movements of the respective cones 39 to cancel each other out at summing and cancelling stage 71 at or before the input to audio mixer 59. As mentioned previously, this allows the out-of-phase acoustic waves generated by the two (or more) drivers' motions to still cancel each other in the air space surrounding the speaker system with no disturbance from any electronic negative feedback.

The degree to which they cancel in space is known to be quite acceptable from both a measurement standpoint and from its success in the marketplace as a means to produce a very satisfactory, relatively pure, bass sound. Since out-of-phase even harmonics are the first and principal content of distortion to arise as sound power level increases, not having to take care of them by feedback allows the feedback system to handle the generally somewhat lesser problem of the 3rd and other odd-order in-phase distortion harmonics, as well as the much lesser amounts of the in-phase 2nd and other in-phase even-order distortion harmonics which, except in the highest few dB of fundamentals, most often are relatively small compared to the out-of-phase even-order distortion harmonics.

This solution permits a feedback system which has a single power amplifier, less gain in the feedback loop and therefore more stability, less cost, and whose design can allow the system to better respond to transient sound behavior which is known to suffer in the presence of high gain feedback systems with respect to recovery from very high level transients or high input signal overload.

The invention as described has been found to provide a variety of benefits:

1. This approach enables the speaker system to retain the large signal acoustic cancellation of out-of-phase even-order distortion harmonics, meanwhile using the minimum of feedback necessary for only in-phase distortion reduction and thereby gaining the opportunity for better transient sound behavior and greater margin of freedom from feedback instability, as well as the lower gain in the feedback loop reducing the need for setting a limiter on signal amplitude to a costly (for performance) low level to avoid bad hangup and misbehavior on high short peaks or long overload.

2. It is already known that the sound of a push-pull system is very acceptable and saleable in the marketplace, and there is a strong desire not to give this up at this time for a negative feedback only system and its different characteristic sound. It is hard to say and even to measure, but every knowledgeable buyer knows when he hears and feels the bass kick he gets at the big concerts and symphony halls, whether or not he wants to buy the subwoofer offered for his home. Originally, it was the objective of this invention to maintain acoustic reduction of even harmonics (thought to be all out-of-phase) and then remove the odd-harmonics (thought to be all in-phase) by feedback (since push-pull will not remove them). However, the system arrived at does this and also simultaneously takes care of in-phase even-harmonics which exist only at the highest sound levels and can easily be made to be relatively small by proper cabinet sizing and are easily removed by the existing feedback in the type of system being described. Any possible, but so far not experienced, out-of-phase odd harmonics would also be cancelled by acoustic cancellation.

3. A reduction of the order of 20% to 25% in total cost of manufacture by allowing one chain of only modest gain amplifiers with appropriate frequency equalization and phase control to a) maintain stability, b) provide high but adequate power-limiting, and c) permit one power amplifier and power supply instead of the two such complete and isolated chains and power amplifiers for the two drivers, which would be needed if total in-phase and out-of-phase harmonic reduction is attempted by feedback on a push-pull system. Without the removal of out-of-phase distortion signals from the feedback signal sent to the mixer in a push-pull driver arrangement with one amplifier chain and one power amplifier, one driver's even-order distortion would be lowered but the other driver's out-of-phase even-order distortion would be greatly increased, possibly into instability at any reasonable feedback gain level. Since the acoustic cancellation of out-of phase even-order distortion takes care of the problem and has other advantages, it appears preferable.

4. Out-of-phase distortion harmonic content is much reduced by the almost complete cancellation of it by the acoustical process in the space around the two drivers, both in the space outside the cabinet and inside, near the center of the cabinet. That is, at the place in a cycle of an input source waveform when one driver is making a little too much pressure both in the cabinet and outside of it, the other driver is making a little too little at the even-order distortion harmonic frequencies and the role of each driver reverses each half cycle. Also, the out-of-phase signals from the sensors 51, 52 can be made to cancel very nearly perfectly and do not enter the negative feedback loop in the single power amplifier type of system described herein. If one side of the out-of-phase signals happened to predominate (for example, from an out of specification magnet or voice coil), which is rather unlikely with automated test procedures on components and end product on a production line, and the error did enter the feedback loop, it would lower the distortion harmonics of one driver while raising the distortion of the other, but only to the extent of the difference, and would be operating on harmonics which are already almost canceling each other in the air outside the cabinet and within the cabinet. To prevent this modest enlargement, one could use two separate amplifiers and try to maintain an adjustable balance push-pull system, but the requirement of two power amplifiers and many other stages is not cost effective and potentially much less stable. Two fairly high-gain, strongly coupled (by the air pressure in the cabinet) feedback systems would be required, with much increased potential for instability, which has been observed in test models of such an arrangement.

5. Additionally, should any elements of the feedback loop in the single amplifier, non-overlapping feedback plus acoustic-harmonic-cancellation system described herein, decay or fail through improper use or long service, the acoustic harmonic cancellation continues to perform, unless at least one of the drivers stops producing substantial useful sound. Prior to the improvements described in this specification, acoustic cancellation was considered a good reduction of even-order distortion harmonics and a design of outstanding overall performance which fared well in the market place. Although the improvement described herein will be very noticeable in home theater or high level bass sounds in music, this new type of further improvement in distortion reduction may be said, if and when it may do so, to fail "gracefully" and leave a still useable system with significant distortion reduction remaining.

FURTHER DETAILS ON THE ORIGIN OF OUT-OF-PHASE EVEN-ORDER DISTORTION

Out-of-phase even-order distortion in a push-pull (as well as any single driver) system at moderate amplitudes arises in large measure, because the permanent-magnet-produced magnetic field in which the voice coil finds itself, is substantially different, say larger, (except in extremely expensive, highly modified shaped pole piece and otherwise modified drivers) when part of the voice coil moves beyond one edge of the pole piece gap, compared to when another part of it moves beyond the other edge of the pole piece gap.

But, it is clearly not possible to correct a single power amplifier in a push-pull system using two or more drivers to make one driver move further out and the other driver not move as far out at the same time. Negative feedback works by ultimately correcting the voltage applied to the drivers. Of course, a larger and a smaller voltage cannot occur simultaneously out of a single amplifier output. Therefore, in this case, acoustic cancellation is used. Also, and as a separate issue, to be perfectly clear, it is possible to use one amplifier to drive both drivers if they are both mounted with cones facing out of the cabinet and use negative feedback to correct the too small excursion of both which now would occur at the same time as would the too large excursions at their same appropriate time. However, as previously mentioned, it is perfectly possible to not use feedback but to use push-pull for this task on even-order harmonics for the variety of reasons already given.

INTERMODULATION DISTORTION

Intermodulation distortion, sometimes just as, or more serious than harmonic distortion, is of a nature that occurs when two strong desired fundamental signals at, for example, 20 Hz and 45 Hz, cause sound output to result at 45+20 or 65 Hz and 45−20 or 25 Hz. (Also included in intermodulation distortion are such frequencies as 45+2×20 or 85 Hz and 45−2×20 or 5 Hz). Intermodulation distortion is serious, because it produces frequencies not contained in the original signal which are not harmonics (exact multiples of the original frequency). Since the presence of harmonics not contained in the original signal occurs because of non-linear factors in the speaker mechanisms, the great reduction of the non-linear transfer function by a negative feedback of in-phase harmonics and a cancellation acoustically in space of the out-of-phase harmonics amounts to a great reduction in total non-linearity and hence a reduction in intermodulation distortion. Also, should any intermodulation occur in-phase in the two drivers, the negative feedback system would greatly reduce it and if out-of-phase (since the drivers are driven out-of-phase but radiate in-phase), it would cancel so it is subject to reduction similar to harmonic reduction, i.e. the non-linear transfer function is reduced.

When the electronic feedback signal, with its out-of-phase harmonics cancelled and in-phase harmonics present, was fed through amplifier 74 (see FIG. 7) to an op-amp 72 using its negative input terminal, another op-amp 59 could then be used as a mixer stage. It was later found that although the first op-amp arrangement 71 performed one function, namely canceling out-of-phase harmonics and adding in-phase harmonics, the second op-amp 59 performed a second function, i.e. that of mixing the desired feedback signal 73 with the main audio input 57 to be amplified and reproduced by the speaker drivers. This enabled distortion of out-of-phase harmonics to be greatly reduced acoustically, and in-phase harmonics to be greatly reduced by electronic negative feedback. At a slight loss of flexibility, a single op-amp arrangement (not shown) could be made to perform both tasks. In either system, a single op-amp 59 (excluding op-amp arrangement 71) or a first and second op-amp arrangement 71, 59 which receives at its positive input terminal a music or voice or audio signal, the loud speakers are able to radiate the music or voice signal with distortion harmonics resulting from even harmonics nearly canceling (actually being substantially reduced acoustically) by virtue of the sound radiated from the normal facing driver combining with the sound radiated from the inverted driver canceling out in space. Then, with the fundamentals only very slightly reduced and at the same time, the odd harmonics, greatly reduced by virtue of the negative feedback operation of the amplifier system, the desired result is accomplished.

Figures 9A, 9B, 9C:
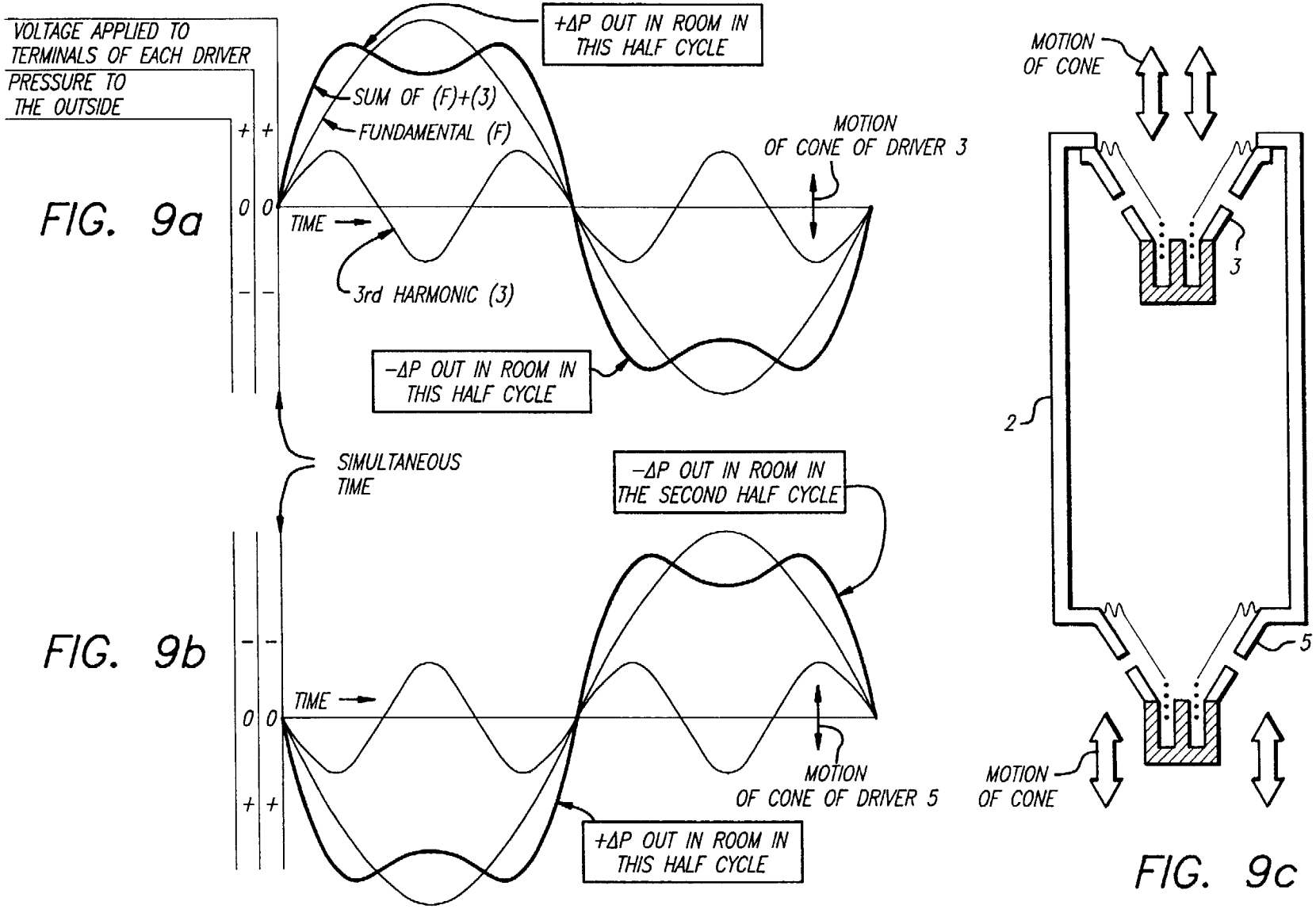
FIG. 9 illustrates the relationship between fundamental waveforms (always in phase) and their in-phase 3rd harmonic component, as well as the sum thereof, for the two drivers in a push-pull system in which the two drivers are at opposite ends of the cabinet, which is intended to also show, among other things, that in push-pull, the only two directions that matter are out and in with respect to the cabinet and the waves and arrows shown are in-phase.

FIG. 9 correlates the fundamental, 3rd harmonic, combined 3rd harmonic and fundamental, and cone motion of each of two push-pull mounted drivers. As depicted in this figure, positive outside air pressure is produced as shown to be in the upward direction for driver 3 (waveform a) which has its cone facing out of enclosure 2, while positive outside air pressure is produced as shown to be in the downward direction for driver 5 (waveform b) which has its cone facing into enclosure 2. The waveforms as shown, then, correlate directly with the physical cone movement of drivers 3 and 5 mounted on opposite sides of enclosure 2. The sums show each speaker with a flattened peak on both its inward and outward motion. Neither driver shows any acoustical out-of-phase difference in relation to the other driver and therefore no acoustical cancellation takes place, in point of fact, this situation could only exist to represent what is left after acoustic cancellation has occurred. It also shows what care must be taken to interpret a diagram in which motions seemingly out-of-phase are really in-phase. Yet, these waveforms show considerable in-phase distortion, so something else must be used (such as feedback) to reduce this distortion. Since the two drivers are on opposite panels of the cabinet, all waves-shown (fundamental, 3rd and sum) are each in-phase with the same curve for the other driver which illustrates that into-the-cabinet and out-of-the cabinet are the only important factors to consider to determine in-phase or out-of-phase conditions. The handling of in-phase distortion harmonics has already been described above. FIG. 9 simply shows a waveform analysis of an alternate physical arrangement of drivers in the enclosed than previously analyzed.

Figure 11:
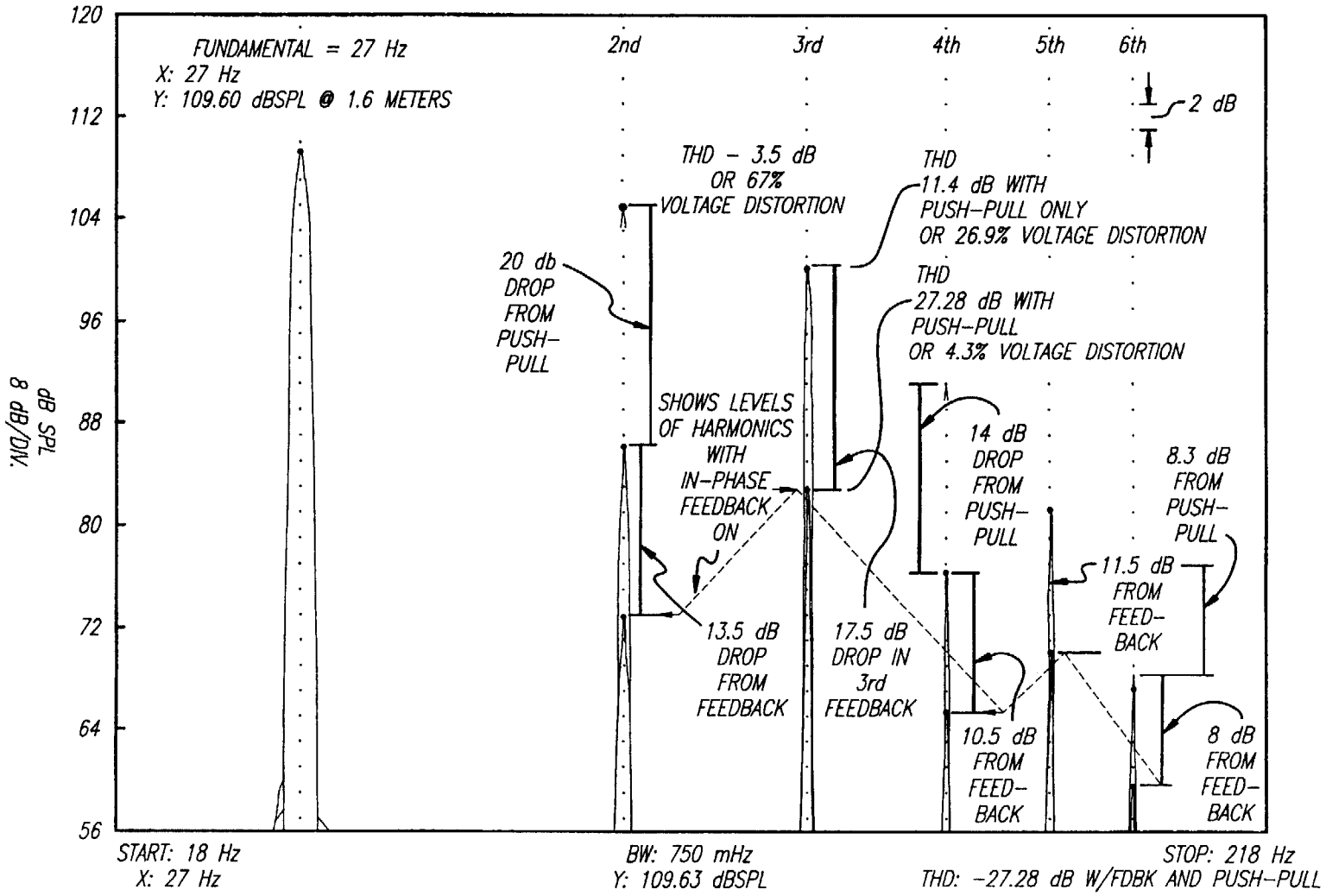
FIG. 11 shows spectrum analyzer results with push-pull working, and with and without the present invention in operation, for a very high sound power level.

FIGS. 10 and 11 illustrate test results performed on a spectrum analyzer for various configurations of the present invention, with and without feedback, with and without push-pull (FIG. 10 only) and with normal (FIG. 10) and very high (FIG. 11) sound levels being emitted. All tests indicated in these figure are taken with the audio sensing transducer placed at 1.6 meters from the speaker enclosure.

FIG. 10, in particular, shows test results using sensors 51, 52 with a moderate to high level fundamental audio signal applied to a push-pull system driven by a single amplifier. Here, a fundamental frequency at 27.5 Hz and 100 dB SPL at 1.6 meters is applied, and, without push-pull and without electrical feedback in accordance with the present invention, the 2nd through 8th distortion harmonics are shown as the outer response curve at each frequency (labeled with a circled 1). Without feedback, but with push-pull cancellation, the even-order harmonics (2nd, 4th, 6th and 8th) are reduced significantly, but the odd-order harmonics (3rd, 5th, and 7th) are relatively unaffected (labeled with a circled 2). Then with added electronic feedback, major reduction of odd-order harmonics and additional reduction of in-phase even-order harmonics (from a different cause than the major even-order harmonics lowered by push-pull and relatively minor in amplitude at all levels except the top few dB) is realized (labeled with a circled 3). Values of all harmonics with only push-pull cancellation in effect are shown as the highest peak points on the graph within the outer response curves. The horizontal connecting lines indicate the amplitudes of the harmonics with push-pull cancellation and feedback applied. This graph thus shows an approximately 24 dB drop in the 2nd harmonic from application of push-pull. Even though the 2nd order distortion harmonic is very low, about 32.6 dB below the fundamental due to the acoustic cancellation of the push-pull system, FIG. 10 shows an even further drop, but only to the extent of 3.5 dB which indicates that even-order in-phase distortion harmonics requiring feedback to remove is almost negligible, or there may be a slight difference in balance of the two drivers to completely cancel the 2nd harmonic at this level, or there may be a difference in how the two out-of-phase waves got to the microphone including reflections. The 3rd harmonic was dropped 18.4 dB by feedback showing the efficacy of the feedback system but the absence of much effect on the even harmonics and the effectiveness of push-pull. It is interesting to note that in the 6th and 8th harmonics only one graph line shows, to wit, no push-pull and no feedback. Push-pull alone dropped its values below the chart, which is 50 dB below the fundamental. This is useful but more interesting is that push-pull cancellation phase held well out to the 8th harmonic or 8 times the fundamental frequency; 220 Hz and at 7 times the fundamental the 7th harmonic showed no drop from push-pull, the same as all other odd harmonics but feedback dropped below the chart bottom at 50 dB down below fundamental.

FIG. 11 is similar to that of FIG. 10, except that the fundamental is increased in magnitude by about 10 dB SPL, to a very high audio level, 110 dB SPL at 1.6 meters. This figure shows a reduction of 19 dB from acoustic cancellation of the 2nd harmonic distortion. Also, the 3rd distortion harmonic is reduced by approximately 16 dB with feedback, and, because this is the region within a few dB of the maximum sound power possible, the cabinet size influenced the non linear air compression to show a much higher decrease (about 13 dB) from feedback in the 2nd-order distortion harmonic level, as compared to the 3.5 dB decrease in FIG. 10, is demonstrated. At these high audio levels, the improvement in both even- and odd-order distortion harmonic levels are quite evident, and to emphasize the improvement, a dashed line is drawn to connect the distortion levels at the different harmonic intervals in the spectrum with feedback turned on. Since out-of-phase distortion is acoustically cancelled by the push-pull arrangement, FIG. 11 clearly demonstrates the fact that the even-order distortion harmonics (2nd, 4th, etc.) at very near the highest levels must necessarily also have an in-phase content for it to be cancelled by the phase selective feedback cancellation system according to the present invention.

The level of in-phase feedback may need adjustment to provide only enough negative feedback to drop the 3rd harmonic to a level comparable with or slightly less than the level of the 2nd distortion harmonic (as reduced by push-pull) and the small portion of in-phase 2nd reduced by feedback as in FIG. 10 or FIG. 11 (which is a rare condition only found on peaks). This allows the feedback loop gain to be a minimum to take advantage of not having to reduce the very large 2nd distortion harmonic, but rather to work on the substantially lower 3rd. This minimum loop gain can be factory adjusted at the last electronic inspection by varying the gain in the loop since the audio mixer has a variable gain element in it shown in FIG. 5 and FIG. 6 by stage 59 (shown with an arrow indicating an adjustable gain control and in FIG. 7 by the arrow through resistor 61. Varying potentiometer 76 in both block diagrams and the schematic can also be used to provide optimum in-phase negative feedback drive to allow minimum loop gain whose benefits permit a number of advantages to not having to correct the very high initial second distortion harmonic as previously described. Small potentiometers to fit circuit board construction and setting as described are readily available.

It may also be desirable to vary the amount of out-of-phase distortion harmonic cancellation in a push-pull system. Recognizing that the two drivers 3, 5 are substantially identical in performance, and that acoustic cancellation of the out-of-phase distortion harmonics requires equal (but opposite phase) outputs from the two drivers, the effect of out-of-phase cancellation can be varied by introducing an unbalance in the outputs of the two drivers. While this could serve to change the balance of in-phase to out-of-phase harmonic distortion because of greater or less cancellation, it has no effect on the character of other sound radiating from the loudspeaker system except for a slight lowering of volume level which, of course, can be easily compensated for by turning up the audio gain of the system. Offsetting the balance between the two drivers 3, 5 can be done in a number of ways, one being to add a variable resistor in series with one of the leads of one of the drivers 3, 5, such as resistor 8 shown in FIG. 5. Resistor 8 should be of a value from 0.5 to 1.5 times the rated input impedance of the driver to which it is connected. The resistor 8 may be in series with or paralleled by a capacitance or inductance (not shown) as appropriate. The dashed lines connecting resistor 8 to driver 3 indicate that this is an optional feature. Another way to change the ratio of out-of-phase distortion harmonics (all even-order) to in-phase distortion harmonics (essentially all odd-order), mildly, if desired, is by slightly unbalancing the balance control on preamp 67. Odd harmonics can also be independently controlled by varying the feedback level. This is not a suggestion, just an indication that it appears possible to do so.

Figure 12:
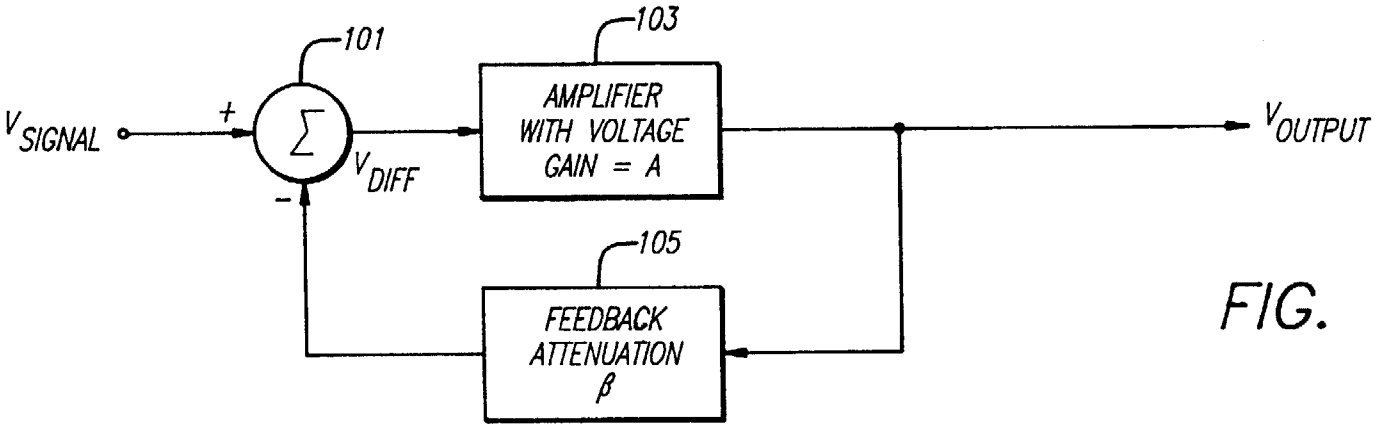
FIG. 12 is a functional block diagram of a basic amplifier with feedback.
Figure 13:
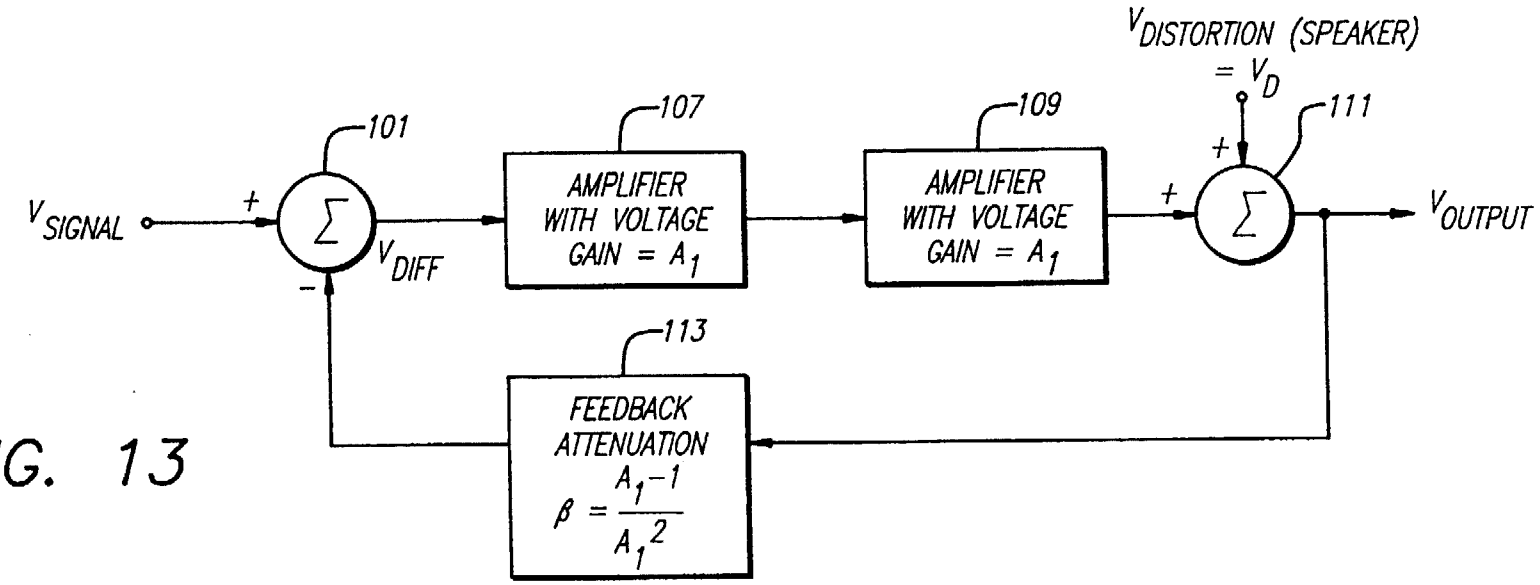
FIG. 13 is a functional block diagram of an amplifier incorporating speaker distortion reduction using feedback.

FIGS. 12 and 13 show the functional components of the following feedback derivations.

DERIVATION OF GAIN OF AMPLIFIER WITH FEEDBACK

FIG. 12 illustrates in functional block diagram form, an amplifier 103 with gain A and feedback attenuation β (block 105). $V_{diff.}$ is the difference that remains when the mixer 101 subtracts ($V_{output}\times\beta$) from $V_{signal}$.

$$V_{diff.} = V_{sig.} - \beta V_{out} \quad (1)$$
$$V_{out} = A \times V_{diff.}$$
$$V_{out} = A V_{sig.} - A \beta V_{out}$$
$$V_{out} (1 + A \beta) = A V_{sig.}$$

Gain with feedback is then: $V_{out}/V_{sig.}=A/(1+A\beta)$ or $V_{out}/V_{sig.}\cong A/A\beta=1/\beta$ for $A\beta>>1$

DERIVATION OF SPEAKER DISTORTION REDUCTION BY FEEDBACK

FIG. 13 illustrates, in functional block diagram form, a pair of amplifiers 107, 109 in series, speaker distortion as another input and feedback attenuation $\beta=(A_1-1)/A_1^2$. In accordance with the easy way to get a simple, clean and easily derived and remembered solution, it is useful to use the amplifier gain as $A_1^2$ (2 stages with gain of $A_1$). Then, to get a very simple answer for distortion reduction, use $$\beta=(A_1-1)/A_1^2 \text{ or } \beta\cong 1/A_1 \text{ for } A_1>>1.$$

Using the gain calculation above (describing FIG. 12), let $A=A_1^2$ and $\beta=(A_1-1)/A_1^2$. Also $A_1=\infty\sqrt{A}$.

Then amplification with feedback on, called $A_f=V_{out}/V_{sig.}$ $$V_{out}/V_{sig.} = A/(1 + A\beta), \quad \text{and thus} \quad (1)$$

$$V_{out}/V_{sig.} = A_1^2/(1 + A_1^2((A_1 - 1)/A_1^2)) = A_1^2/(1 + A_1 - 1) = A_1 = \sqrt{A}$$

To calculate distortion and signal gain separately, then superpose, now with distortion only (with no $V_{sig.}$):

$$V_{diff}=\beta V_{out}=-(A_1-1)/A_1^2 V_{out} \quad (2)$$

$$V_{out}=V_D+V_{diff.} A_1^2 \quad (3)$$

$$V_{out}=V_D+(-((A_1-1)/A_1^2)V_{out})A_1^2 \quad (4)$$

$$V_{out}=V_D-A_1 V_{out}+V_{out} \quad (5)$$

$$V_{out}=V_D/A_1 \text{ with feedback} \quad (6)$$

Superposed Result:

With no feedback (feedback disconnected), the gain $$A=A_1^2 \quad (7)$$

and $$V_{out}=V_{sig.} A_1^2+V_D \quad (8)$$

but with feedback:

$$V_{out}=V_{sig.} A_1+V_D/A_1 \text{ from (1) and (6)} \quad (9)$$

Where $V_D$ is the voltage equivalent of what it would take to generate the distortion that the deficiency or non-linearity produce, except that the portion of $V_D$ representing the out-of-phase distortion in the system described in this document is removed from the feedback signal before it enters the mixer stage, since the acoustic cancellation already lowers the out-of-phase distortion harmonic without the feedback process.

This analysis shows that, according to formula (9), the signal component of the output is multiplied by $A_1$, while the distortion component of the output is divided by $A_1$. In effect, feedback makes the gain drop from $A_1^2$ to $A_1$ and makes speaker produced distortion drop from $V_D$ to $V_D/A_1$. $A_1$ needs to be enough gain to drive the speaker drivers to their maximum allowable movement (excursion) before gross distortion sets in by the spider and/or the surround being stretched to their reasonable limits, or the voice coil former or any other member of the moving system striking the back plate of the magnet. The amplifier also must be capable of providing the speaker drive voltage and consequent current without flattening of the tops of the presumed sine waves or peaks required by program material. If $A_1$ is not sufficient gain for the given audio signal maximum, more gain may be added in the gain section of the feedback loop, or better still, if this produces feedback instability beyond the capability of loop equalization and phase correction, the requisite added gain may be had in stages prior to the feedback loop, or is often readily available from a preamplifier.

DIGITAL IMPLEMENTATION OF THE INVENTION

Figure 14:
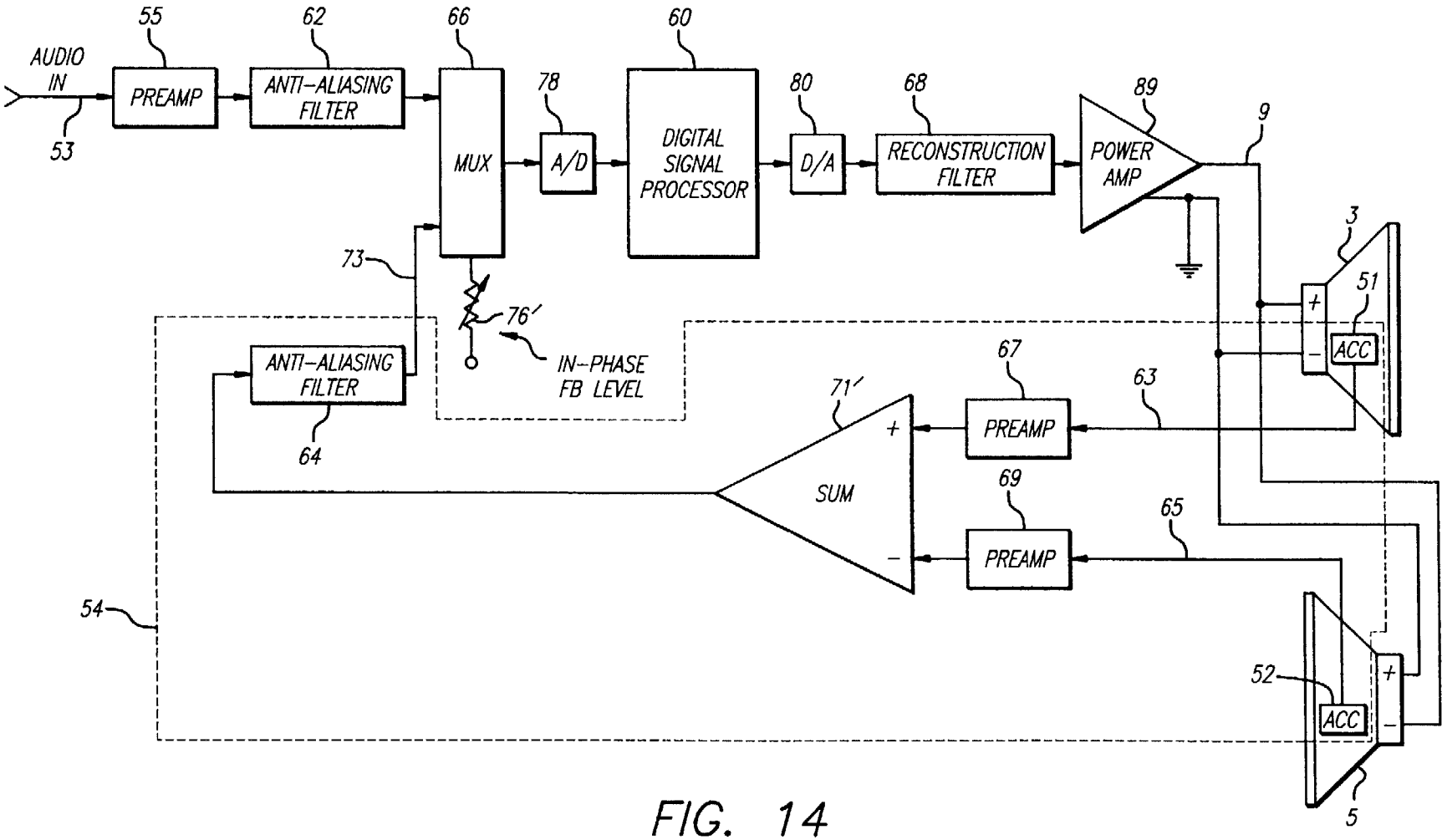
FIG. 14 is a block diagram similar to that of FIG. 5, modified to show a digital embodiment of the invention.

FIG. 14 illustrates a form of the invention wherein the major portion of the processing is done digitally. The "IN-PHASE FEEDBACK LEVEL" potentiometer 76' is illustrated schematically to indicate that a linearly moveable or incrementally moveable user control can fix the amount of contribution to the audio input signal that is coming from the feedback loop on line 73. Since it is common knowledge how to mix and change amplitudes of audio signals in digital format, it is not necessary to elaborate in this description. The audio signal from the source on line 53 is amplified by an analog preamp 55 and applied to an antialiasing low pass filter 62 to remove the undesirable high frequency components. The resulting low passed signal is applied to one channel of an analog multiplexer 66. The multiplexer 66 alternately feeds the audio input from filter 62 and the summed signal (reinforced in-phase signals and cancelled out-of-phase signals from the accelerometers) from filter 64 derived from the accelerometers 51, 52 to a single A/D converter 78. In this manner, the A/D converter 78 samples both the audio signal and accelerometer signal, converts each one to a digital number and sends them to the digital signal processor (DSP) 60. The DSP 60 provides the correct filtering, phase compensation, and feedback gain for the servo control loop and also muting, and clipping protection for the power amplifier 89. The DSP 60 may be a general purpose digital processing chip or implemented in a dedicated application specific integrated circuit. The output of the DSP 60 is sent to a D/A converter 80 and a reconstruction filter 68 to convert the digital bit stream back to an analog signal to drive the power amplifier 89. The power amplifier 89 drives the drivers 3, 5 in a push-pull configuration (like the analog version of FIG. 5). The signal from accelerometers 51, 52 are amplified by their respective preamps 67, 69, summed (adding in-phase and cancelling out-of-phase signal components), fed to antialiasing filter 64 and into the analog multiplexer 66 to complete the feedback loop. The diagram represents only one possible implementation of a digital signal processing version of the push-pull feedback system with feedback, and alterations of such a system will be readily apparent to those skilled in the art without departing from the concept intended to be conveyed. For example, the outputs of preamplifiers 67 and 69, or the outputs of sensors 51 and 52 themselves, could be digitized. The system of FIG. 14, then, is merely a preferred embodiment of the digitized version of the present invention.

Changes may be made in the construction and the operation of the various components and assemblies described herein and changes may be made in the step or the sequence of steps of the methods described herein without departing from the spirit and scope of the .invention as defined in the following claims.

We claim:

1. A loudspeaker system for bass frequencies, comprising:

an enclosure;

at least one pair of loudspeaker drivers mounted to said enclosure, each driver including a frame, a magnet, a voice coil, a cone, and plus and minus input terminals leading to its voice coil, one driver of each pair being normally mounted with its cone facing outward from said enclosure and its magnet and frame inside said enclosure, and the other driver of each pair being inversely mounted with its cone facing into said enclosure and its magnet and frame outside said enclosure, said drivers substantially identically constructed, the plus terminal of one driver of each said pair connected to the minus terminal of the other driver of each said pair and the minus terminal of said one driver connected to the plus terminal of said other driver;

amplifier means for receiving an input signal and driving said pair of connected drivers with a driving signal thereby producing an audio output from each driver;

sensing means including a sensor coupled to at least one of the drivers having its cone facing out of said enclosure, and to at least one of the drivers having its cone facing into each enclosure, each sensor sensing all fundamental and harmonic components of cone motion including all distortion harmonic components produced by its respective driver's deficiencies, each said sensor producing an electrical output signal representing said components; and feedback means, responsive to the outputs from said sensing means, for developing and coupling a control signal to said amplifier means to alter said driving signal in a manner to effectively reduce only in-phase distortion harmonics, as between the normally and inversely mounted drivers of each pair, which are distortion harmonic components in said driver outputs which were not components of said input signal.

2. The system as claimed in claim 1, wherein said feedback means comprises means for electronically isolating the in-phase distortion-produced harmonic content by cancelling only the sensed out-of-phase distortion-produced harmonic content, as between each pair of drivers, and thereby keeping such out-of-phase content out of said control signal and from being coupled to said amplifier means.

3. The system as claimed in claim 2, wherein said feedback means comprises a summing and cancelling stage for summing all in-phase content from both sensors of a driver pair, which includes all original fundamentals and their natural sound derived harmonics of said input signal, as well as driver produced distortion in-phase harmonics.

4. The system as claimed in claim 2, wherein:

said in-phase distortion harmonic components include odd-order distortion harmonics of said driver's cone motion for the full range of driving signal amplitudes the drivers are capable of accepting; and said in-phase distortion harmonic components further include even-order distortion harmonics of said driver's cone motion which arise at medium to the highest driving signal amplitudes the drivers are capable of accepting.

5. The system as claimed in claim 1, wherein the drivers of each said driver pair are of similar design so as to acoustically reduce, in the space surrounding said enclosure, out-of-phase even-order distortion harmonic driver output components for the full range of driving signal amplitudes and which were not components of said input signal.

6. The system as claimed in claim 5, wherein said sensing means and said feedback means operate to effectively reduce said in-phase distortion harmonic components without appreciably influencing reduction of said out-of-phase even-order distortion harmonic driver output components.

7. The system as claimed in claim 2, wherein the drivers of each said driver pair are of similar design and size so as to acoustically reduce, in the space surrounding said enclosure, out-of-phase distortion harmonic driver output components which were not components of said input signal.

8. A loudspeaker system for bass frequencies, comprising:

an enclosure;

at least one pair of loudspeaker drivers, all constructed to have similar audio parameter characteristics, mounted to said enclosure such that one driver of each pair is mounted with its cone facing out of said enclosure and the other driver of each pair is mounted with its cone facing into said enclosure, said one driver and said other driver of each pair being driven by an amplifier and connected 180° out of phase with each other electronically which is necessary for producing in-phase motion of the outward facing cones or said drivers to thereby produce in-phase sound radiation responsive to a driving signal;

amplifier means responsive to an input signal for driving said pair of drivers with a driving signal and producing an audio output from each driver;

a sensing means including a sensor coupled to at least one of the drivers having its cone facing out of said enclosure, and to at least one of the drivers having its cone facing into each enclosure, each sensor sensing all cone motion including all distortion harmonic components produced by it's respective driver's deficiencies, said sensing means producing an electrical signal output signal containing summed in-phase and lacking cancelled out-of-phase electrical signals from said sensors; and feedback means, responsive to the outputs from said sensing means, for developing and coupling a control signal to said amplifier means to alter said driving signal in a manner to effectively reduce only in-phase distortion harmonic components in said driver outputs which were not components of said input signal.

9. The system as claimed in claim 8, wherein each said driver includes a voice coil wound on a voice coil former, and each said sensors is mounted on the voice coil former of its respective driver.

10. The system as claimed in claim 8, wherein each said sensors is an acceleration sensor.

11. The system as claimed in claim 8 wherein:

said feedback means includes a single summing and canceling stage;

each said sensors is a motion sensor;

the electrical outputs of said sensing means associated with each pair of drivers are arranged to be in-phase with each other for all cone motions of said pair of drivers which are equal and moving together in phase to simultaneously compress or rarefy the air outside said enclosure;

the output of each said sensing means associated with a pair of drivers is coupled to the input of said summing and canceling stage which cancels out-of-phase sensed cone motions and adds in-phase sensed cone motions as determined by positive or negative pressure production on the air outside said enclosure when mounted with their cones facing into and out of said enclosure, respectively; and said amplifier includes a mixer stage with plus and minus input terminals, the output of said summing and cancelling stage being coupled to said amplifier via said feedback means to the negative input terminal of said mixer stage, the positive input terminal of said mixer stage receiving said input signals.

12. The system as claimed in claim 11, comprising a signal level controller coupled between said sensing means and said amplifier means, and wherein:

said signal level controller is effective to fixedly set or to vary the amount of output from said summing and cancelling stage reaching said amplifier means, thereby providing manufacturer or user control, respectively, of the amount of reduction of in-phase distortion harmonic content outputted by said drivers.

13. The system as claimed in claim 8, comprising a first analog-to-digital means for converting said input signal to digital format, and wherein:

said feedback means comprises a second analog-to-digital means for converting said output of said sensing means to digital format;

said amplifier means comprises a digital processor for processing said digitally formatted input signal and said digitally formatted output from said sensing means, and for producing a digital driving signal; and said amplifier means further comprises a digital-to-analog means for converting said digital driving signal to analog format, and an analog amplifier to drive said pair of drivers.

14. The system as claimed in claim 8, wherein:

each said driver voice coil is wound on a voice coil former;

each said sensors is a motion sensor;

each said sensor is mounted on said voice coil former, the output of each sensor routed along wires passing through the cone of the respective driver to connecting terminals fixed to said driver frame.

15. The system as claimed in claim 14, wherein said wires define a highly flexible coaxial cable.

16. The system as claimed in claim 14, comprising an aluminum or other non-magnetic metal or non-conducting plastic bridge fixed to said voice coil former, and wherein said sensor is glued to said bridge using high strength, high temperature adhesive.

17. A method for improving the quality of sound from a loudspeaker system for bass frequencies, comprising the steps of:

providing an enclosure;

mounting at least one pair of loudspeaker drivers to said enclosure, each driver including a frame, a magnet, a voice coil, a cone, and plus and minus input terminals leading to its voice coil, one driver of each pair mounted with its cone facing outward from said enclosure and its magnet and frame inside said enclosure, and the other driver of each pair mounted with its cone facing into said enclosure and its magnet and frame outside said enclosure, said drivers similarly constructed to alternately compress and rarefy air on the same side of each cone when a positive and negative voltage, respectively, is applied to said plus input terminal relative to said minus input terminal, the plus terminal of one driver of each said pair connected to the minus terminal of the other driver of each said pair and the minus terminal of said one driver connected to the plus terminal of said other driver;

driving said pair of connected drivers with a single driving signal from a single power amplifier fed by an input signal and producing an audio output from each driver;

sensing all fundamental and harmonic components of cone motion of each driver including all distortion harmonic components produced due to deficiencies of each said driver, and producing an electrical signal output representing said components; and developing, responsive to said sensing step, a control signal and coupling said control signal to said amplifier means to alter said driving signal in a manner to effectively reduce only in-phase distortion harmonic components in said driver outputs which were not components of said input signal.

18. The method as claimed in claim 17, comprising the step of canceling sensed out-of-phase distortion-produced harmonic content, as between each pair of drivers, and thereby keeping such out-of-phase content out of said control signal and from being coupled to said amplifier means.

19. The method as claimed in claim 17, wherein:

said in-phase distortion harmonic components include odd-order distortion harmonics of said driver's cone motion for the full range of driving signal amplitudes the drivers are capable of producing; and said in-phase distortion harmonic components include even-order distortion harmonics of said driver's cone motion which generally arise at near medium to the highest driving signal amplitudes the drivers are capable of accepting.

20. The method as claimed in claim 17, wherein the drivers of each said driver pair are chosen to be of similar design so as to acoustically reduce, in the space surrounding said enclosure, the out-of-phase distortion harmonic driver output components, as between the two drivers of a driver pair, which were not components of said input signal.

21. The method as claimed in claim 20, wherein said developing and coupling step is effective to effectively reduce said in-phase harmonic components without influencing said acoustic reduction of said out-of-phase harmonic speaker output components.

22. The method as claimed in claim 18, wherein the drivers of each said driver pair are chosen to be of similar design so as to acoustically reduce, in the space surrounding said enclosure, out-of-phase distortion harmonic driver output components which were not components of said input signal.

23. A method for improving the quality of sound from a loudspeaker system for bass frequencies, comprising the steps of:

providing an enclosure;

mounting at least one pair of loudspeaker drivers, all constructed to have similar audio parameter characteristics, to said enclosure such that one driver of each pair is mounted with its cone facing out of said enclosure and the other driver of each pair is mounted with its cone facing into said enclosure, said one driver and said other driver of each pair being driven by an amplifier and connected 180° out of phase with each other electronically for radiating input signals in-phase acoustically;

driving said pair of drivers, responsive to receiving said input signal, with a driving signal and producing an audio output from each driver;

sensing all cone motion of the drivers of at least one driver pair including all distortion harmonic components produced due to deficiencies of each said driver; and responsive to sensing cone motion of said at least one driver pair, developing and coupling a control signal and altering said driving signal in a manner to effectively reduce in-phase distortion harmonic components in said driver outputs which were not components of said input signal.

24. The method as claimed in claim 23, wherein said step of effectively reducing in-phase distortion harmonic components employs negative feedback techniques.

25. A method for improving the quality of sound from a loudspeaker system for bass frequencies, comprising the steps of:

providing an enclosure;

mounting at least one pair of loudspeaker drivers, all constructed to have similar audio parameter characteristics, to said enclosure such that one driver of each pair is mounted with its cone facing out of said enclosure and the other driver of each pair is mounted with its cone facing into said enclosure, said one driver and said other driver of each pair being driven by an amplifier and connected 180° out of phase with each other electronically but radiating in-phase acoustically;

driving said pair of drivers with a driving signal to thereby produce an audio output from each driver;

sensing all cone motion of each driver including all distortion harmonic components produced due to deficiencies of each said driver's and responsive to the outputs from all said sensing means, developing and coupling a control signal to said amplifier means such that said input signal is multiplied by essentially a gain $A_1$, while the in-phase distortion harmonics, as between the drivers of each pair of drivers, is divided by $A_2$, wherein $A_1$ and or may not equal $A_2$ are of similar magnitude.

26. The method as claimed in claim 25, comprising the step of setting the magnitude of one of the gains $A_1$, $A_2$ and the magnitude of said control signal, thereby providing fixed or user control of the balance of, and amount of reduction of, in-phase distortion harmonic content outputted by said drivers.

27. The method as claimed in claim 25, comprising the step of varying the power level of the driving signal to one driver of each pair to thereby unbalance the power delivery, as between the drivers of a pair of drivers, and alter the amount of out-of-phase distortion harmonic reduction.

28. A loudspeaker system for bass frequencies, comprising:

an enclosure;

loudspeaker driving electronics for receiving an input signal and generating a driving signal;

at least one pair of loudspeaker drivers mounted to said enclosure and driven by said loudspeaker driving electronics;

means for effectively acoustically reducing, in the space outside said enclosure, all out-of-phase distortion harmonics, as between the two drivers, not included in said input signal; and means for effectively electronically reducing, using said loudspeaker driving electronics, all in-phase distortion harmonics, as between the two drivers, not included in said input signal.

29. The system as claimed in claim 28, wherein:

said out-of-phase distortion harmonics are even-order distortion harmonics;

and said in-phase distortion harmonics are primarily odd-order distortion harmonics at audio sound power levels up to and including moderately high audio levels, and are both odd-order and even-order distortion harmonics at audio levels near the maximum audio levels said loudspeaker system is capable of reproducing.

30. The system as claimed in claim 28, wherein said means for reducing includes feedback means, and control means for setting the amount of reduction of in-phase distortion harmonic content outputted by said drivers by varying the amount of feedback signal.

31. The system as claimed in claim 28, comprising means for setting the amount of reduction of out-of-phase distortion harmonic content as between and outputted by said drivers by varying the drive level applied to either driver compared to the other.

32. A loudspeaker system for bass frequencies, comprising:

an enclosure;

an amplifier chain for receiving an input signal and outputting a driving signal;

a power amplifier for receiving said driving signal and producing a power amplifier output signal;

at least one pair of loudspeaker drivers, all constructed to have similar audio parameter characteristics, mounted to said enclosure such that one driver of each pair is mounted with its cone facing out of said enclosure and the other driver of each pair is mounted with its cone facing into said enclosure, said one driver and said other driver of each pair being driven by said power amplifier output signal and connected 180° out of phase with each other electronically for radiating input signals in-phase acoustically, thereby effectively acoustically reducing, in the space outside said enclosure, out-of-phase even-order distortion harmonics which are made to be out-of-phase as between the two drivers by their relative inverted placement and which were not included in said input signal; and feedback means for effectively electronically reducing all in-phase odd-order distortion harmonics and in-phase even-order distortion harmonics, as between the two drivers, not included in said input signal, said feedback means not affecting in any way out-of-phase even-order distortion harmonics already accounted for acoustically.

33. A loudspeaker system for bass frequencies, comprising:

an enclosure;

a power amplifier;

an amplifier chain including a mixer, said amplifier chain receiving an input signal and generating a driving signal coupled to said power amplifier, said input signal being coupled to said mixer;

at least one pair of loudspeaker drivers, all constructed to have similar audio parameter characteristics, mounted to said enclosure such that one driver of each pair is mounted with its cone facing out of said enclosure and the other driver of each pair is mounted with its cone facing into said enclosure, said one driver and said other driver of each pair being driven by said power amplifier output signal and connected 180° out of phase with each other electronically so as to radiate in-phase acoustically responsive to changes in said input signal;

sensing means including a sensor coupled to at least one of the drivers having its cone facing out of said enclosure, and to at least one of the drivers having its cone facing into each enclosure, each sensor sensing all cone motion including all distortion harmonic components produced by its respective driver's deficiencies, said sensing means producing an output; and feedback means, responsive to the outputs from said sensing means, for generating and coupling a control signal to said mixer in said amplifier chain to alter the effects of said driving signal in a manner to greatly reduce in-phase distortion harmonic component motions in said driver motion outputs which were not components of said input signal.

34. The system as claimed in claim 11, using only two said drivers, comprising an electrical output terminal which may be used for other purposes than distortion reduction of the drivers, and in which acoustic harmonic reduction will continue to occur, but where an electrical output terminal can be caused to provide only the summed even-order distortion harmonic signals, contained originally in the out-of-phase motions of the cones and sensors on the drivers (one-inverted) along with other motions such as in-phase fundamentals and natural sound harmonics of the original sound sources and other in-phase distortion harmonics, essentially pure even-order distortion harmonics being available by taking the two signals from the two sensors before one of them passes through a normally used phase inverter stage, then summing the so called out-of-phase even-order driver created distortion harmonics in a second summing and cancelling stage which will sum them and cancel all of the originally in-phase motion signals, one sensor having already been inverted in motion compared to the other, such even-order only harmonics of all the fundamentals being available to be added to a live instrument or, separately, a recording process; electrical signals of primarily odd-order driver created distortion harmonics being already available for similar contemplated uses, and are the signals being fed to the minus input terminal of the mixer, along with some other signals of no consequence in such uses.

35. A loudspeaker system for bass frequencies, comprising:

an enclosure;

an amplifier for receiving an input signal and generating a driving signal;

at least one pair of loudspeaker drivers, all constructed to have similar audio parameter characteristics, mounted to said enclosure such that one driver of each pair is mounted with its cone facing out of said enclosure and the other driver of each pair is mounted with its cone facing into said enclosure, said one driver and said other driver of each pair being driven by said amplifier driving signal and connected 180° out of phase with each other electronically so as to radiate in-phase acoustically responsive to changes in said input signal;

sensing means, including a sensor coupled to at least one of the drivers having its cone facing out of said enclosure, and to at least one of the drivers having its cone facing into each enclosure, each sensor sensing all cone motion including all distortion harmonic components produced by its respective driver's deficiencies, said sensing means producing an electrical output signal; and feedback means, responsive to the output signal from said sensing means, for generating and coupling a control signal to said amplifier to alter the effects of said driving signal in a manner to effectively reduce in-phase distortion harmonic components radiated by said drivers which were not components of said input signal.

36. The system as claimed in claim 35, comprising an electrical output means, responsive to outputs from said sensors, for developing an electrical output signal containing essentially only the summed even-order harmonic components radiated by said drivers which were not components of said input signal, thus making said summed even-order harmonic components available for external use in essentially instantaneous real time.

37. The system as claimed in claim 35, wherein said feedback means comprises an electrical output means, responsive to outputs from said sensors, for developing an electrical output signal containing essentially only the summed harmonic components radiated in-phase as between the drivers of each pair of drivers, which were not components of said input signal, thus making said summed in-phase harmonic components available for use in essentially instantaneous real time.

38. The system as claimed in claim 35, comprising:

a first electrical output means, responsive to outputs from said sensors, for developing an electrical output signal containing essentially only the summed even-order harmonic components radiated by said drivers which were not components of said input signal, thus making said summed even-order harmonic components available for external use in essentially instantaneous real time; and a second electrical output means, responsive to outputs from said sensors, for developing an electrical output signal containing essentially only the summed harmonic components radiated in-phase as between the drivers of each pair of drivers, which were not components of said input signal, thus making said summed in-phase harmonic components available for use in essentially instantaneous real time.

* * * * *